US009309726B2

(12) United States Patent
Tahoun et al.

(10) Patent No.: US 9,309,726 B2
(45) Date of Patent: Apr. 12, 2016

(54) METHOD AND APPARATUS FOR REMOTELY CHANGING FLOW PROFILE IN CONDUIT AND DRILLING BIT

(71) Applicants: Ahmed Tahoun, Agawam, MA (US); Raed I Kafafy, Kuala Lumpur (MY); Karam J Jawamir, Kuala Lumpur (MY); Mohammed A Aldheeb, Kuala Lumpur (MY); Abdul Mushawwir Khalil, Kuala Lumpur (MY)

(72) Inventors: Ahmed Tahoun, Agawam, MA (US); Raed I Kafafy, Kuala Lumpur (MY); Karam J Jawamir, Kuala Lumpur (MY); Mohammed A Aldheeb, Kuala Lumpur (MY); Abdul Mushawwir Khalil, Kuala Lumpur (MY)

(73) Assignee: MIT INNOVATION SDN BHD, Kuala Lumpur (MY)

( * ) Notice: Subject to any disclaimer, the term of this patent is extended or adjusted under 35 U.S.C. 154(b) by 440 days.

(21) Appl. No.: 13/897,348

(22) Filed: May 17, 2013

(65) Prior Publication Data

US 2013/0341035 A1 Dec. 26, 2013

Related U.S. Application Data

(63) Continuation-in-part of application No. 13/846,946, filed on Mar. 18, 2013, and a continuation-in-part of application No. 13/861,255, filed on Apr. 11, 2013, now Pat. No. 9,133,682.

(60) Provisional application No. 61/648,575, filed on May 17, 2012, provisional application No. 61/710,887, filed on Oct. 8, 2012, provisional application No. 61/710,823, filed on Oct. 8, 2012.

(51) Int. Cl.

| | |
|---|---|
| ***E21B 10/61*** | (2006.01) |
| ***E21B 34/06*** | (2006.01) |
| ***E21B 10/18*** | (2006.01) |
| ***E21B 10/38*** | (2006.01) |

(52) U.S. Cl.

CPC ..... *E21B 10/61* (2013.01); *E21B 10/18* (2013.01); *E21B 10/38* (2013.01); *E21B 34/06* (2013.01)

(58) Field of Classification Search

CPC ..... E21B 10/61; E21B 10/60; E21B 10/18; E21B 10/38; E21B 10/602; E21B 10/605; E21B 2010/607; E21B 34/08; E21B 34/10; E21B 34/12; E21B 34/14

See application file for complete search history.

(56) References Cited

U.S. PATENT DOCUMENTS

| | | | |
|---|---|---|---|
| 6,227,316 | B1 | 5/2001 | Rohde |
| 6,280,874 | B1 | 8/2001 | Hensley et al. |

(Continued)

OTHER PUBLICATIONS

International Search Report and Written Opinion dated Jun. 2, 2015, in connection with corresponding PCT International Application No. PCT/IB13/03233 (9pgs).

*Primary Examiner* — Yong-Suk (Philip) Ro

(74) *Attorney, Agent, or Firm* — Maier & Maier, PLLC

(57) ABSTRACT

An apparatus and method for remotely adjusting the hydraulic horse power per square inch (HSI) of a drill bit. The apparatus and method may allow the nozzle geometry to be varied remotely without the need to pull the drill string outside the hole. This nozzle may include a body configured to be secured within the rotary drill bit, and a fluid passage within that body that leads to an orifice. The geometry of the fluid passage may be variable, and varying it may result in a change in the nozzle HSI; this may allow drilling different rock formations to be optimized in different drilling environments. Different placements of the nozzle, such as within the inner flow passage or between the inner flow passage and annular flow passage for controlling flow profile within a wellbore, a tubular string or a flow conduit, may be envisioned.

25 Claims, 17 Drawing Sheets

(56) References Cited

U.S. PATENT DOCUMENTS

2003/0010532 A1 1/2003 Kristiansen et al.
2004/0108138 A1* 6/2004 Cooper ..... E21B 10/60 175/26
2011/0259576 A1* 10/2011 Mulder ..... E21B 19/10 166/77.51

* cited by examiner

A flowchart illustrating the steps of the claimed method of remotely and selectively controlling an apparatus disposed in a string within wellbore.

METHOD AND APPARATUS FOR REMOTELY CHANGING FLOW PROFILE IN CONDUIT AND DRILLING BIT

CROSS-REFERENCE TO RELATED APPLICATIONS

The present application is a continuation-in-part application of U.S. patent application Ser. No. 13/846,946, filed Mar. 18, 2013, for APPARATUS AND METHOD TO REMOTELY CONTROL FLUID FLOW IN TUBULAR STRINGS AND WELLBORE ANNULUS, by Ahmed M. Tahoun, Raed I. Kafafy, Karam J Jawamir, Mohamed A. Aldheeb, Abdul M. Khalil, included by reference herein and for which benefit of the priority date is hereby claimed.

The present application is a continuation-in-part application of U.S. patent application Ser. No. 13/861,255, filed Apr. 11, 2013, for APPARATUS AND METHOD TO REMOTELY CONTROL FLUID FLOW IN TUBULAR STRINGS AND WELLBORE ANNULUS, by Ahmed M. Tahoun, Raed I. Kafafy, Karam J Jawamir, Mohamed A. Aldheeb, Abdul M. Khalil, included by reference herein and for which benefit of the priority date is hereby claimed.

The present application is a continuation-in-part application of U.S. provisional patent application, Ser. No. 61/648,575, filed May 17, 2012, for METHOD AND APPARATUS TO REMOTELY CHANGE THE AREA OF DRILL BIT NOZZLES AND DRILL STRING FLOW RESTRICTORS, by Ahmed M. Tahoun, Raed I. Kafafy, Karam J Jawamir, Mohamed A. Aldheeb, included by reference herein and for which benefit of the priority date is hereby claimed.

The present application is a continuation-in-part application of U.S. provisional patent application, Ser. No. 61/622,572, filed Apr. 11, 2012, for METHOD AND APPARATUS OF CONTROL DRILLING FLUID LOSSES AND IMPROVED HOLE CLEANING IN OIL & GAS SUBTERRANEAN DRILLING OPERATIONS, by Ahmed M. Tahoun, Raed I. Kafafy, Karam J Jawamir, Mohamed A. Aldheeb, included by reference herein and for which benefit of the priority date is hereby claimed.

The present application is a continuation-in-part application of U.S. provisional patent application, Ser. No. U.S. 61/710,823, filed Oct. 19, 2012, for METHOD AND APPARATUS TO HARVEST ENERGY INSIDE WELLBORE FROM CHANGE OF FLUID FLOW RATE, by Ahmed M. Tahoun, Raed I. Kafafy, Karam J Jawamir, Mohamed A. Aldheeb, included by reference herein and for which benefit of the priority date is hereby claimed.

The present application is a continuation-in-part application of U.S. provisional patent application, Ser. No. U.S. 61/710,887, filed Oct. 8, 2012, for METHOD AND APPARATUS TO CONTROL THE MUD FLOW IN DRILL STRINGS AND WELLBORE ANNULUS, by Ahmed M. Tahoun, Raed I. Kafafy, Karam J Jawamir, Mohamed A. Aldheeb, included by reference herein and for which benefit of the priority date is hereby claimed.

The present application is related to U.S. Pat. No. 6,227,316B1, issued Mar. 10, 1999, for JET WITH VARIABLE ORIFICE NOZZLE, by Bruce A. Rohde, included by reference herein.

The present application is related to U.S. Pat. No. 3,120,284, issued Aug. 17, 1959, for JET NOZZLE FOR DRILL BIT, by J. S. Goodwin, included by reference herein.

The present application is related to U.S. Pat. No. 3,137,354, issued Jan. 11, 1960, for DRILL BIT NOZZLES, by A. W. Crawfort Et Al, included by reference herein.

The present application is related to U.S. Pat. No. 4,533,005, issued Nov. 21, 1983, for ADJUSTABLE NOZZLE, by Wilford V Morris, included by reference herein.

The present application is related to United States patent number US20100147594, issued Nov. 8, 2007, for REVERSE NOZZLE DRILL BIT, by Sadek Ben Lamin, included by reference herein.

The present application is related to United States patent number US20090020334, issued Jul. 16, 2008, for NOZZLES INCLUDING SECONDARY PASSAGE, DRILL ASSEMBLIES INCLUDING SAME AND ASSOCIATED METHOD, by David Gavia, included by reference herein.

The present application is related to United States patent number US20110000716, issued Dec. 15, 2009, for DRILL BIT WITH A FLOW INTERRUPTER, by Laurier E Comeau, included by reference herein.

The present application is related to U.S. Pat. No. 8,342,266, issued Mar. 15, 2011, for TIMED STEERING NOZZLE ON A DOWNHOLE DRILL BIT, by David R Hall, included by reference herein.

BACKGROUND

The concept of forming subterranean wells is referred to; a drill string is typically used to drill a wellbore of a first depth into the formation.

While drilling, a drilling fluid (ormud fluid) is circulated down through the tubular string, then through perforation(s) in a drill bit which is located at the end of the drill string. Then, the drilling fluid continues the circulation up through the annular flow passage between the outer perimeter of the tubular string and inner wall of the well.

The mud jets from the bit nozzles are normally directed toward the hole bottom and formation being drilled, with the velocities of several hundred feet per second to create turbulence which serves to clean the bit, as well as carry away the cut chips. The drill bit nozzles are removable flow-restrictors which determine the total area of the drill bit outlet, and therefore the terminal velocity of the mud jet.

The majority of drilling systems in current use include a heavy tubular string with a substantially large outer diameter, and a Bottom Hole Assembly (BHA) linked to that tubular string and located below it. The BHA may include the drill bit, as well as other equipment such as motors, logging while drilling equipment, directional drilling control systems, or any combination thereof. Above the BHA, there normally extend smaller drill pipes connecting the BHA to the surface.

When drilling in earth formations having rapid variations in mechanical properties between layers, the drill bit nozzle hydraulic horse power per square inch (HSI) can be too high for the formation, resulting in the formation being over-drilled, or can be too low for the formation, which results in less efficient removal of cuttings.

Conventionally, the drill bit nozzle lowered in the wellbore has a fixed flow geometry and total flow area (TFA). It is not possible to change to another nozzle geometry except through pulling the tubular string out of the wellbore.

Flow restrictors used within a tubular string during drilling, for example for the mud motor, may have a fixed geometry connecting between the inner flow passage and the annular flow passage. It is desirable to be able to change the flow restrictor flow geometry without the need to pull the tubular string out of the hole.

Flow restrictors exist in other components of the tubular string used for drilling or conduits used for flow of fluid in certain industries (like the oil and gas industry, or other industries at large) that communicate fluid from one point to another. Changing the geometry of flow restrictors remotely is desirable.

The majority of drilling systems used today use drill bit nozzles with fixed total flow area (TFA). One way to change the drill bit nozzle HSI is to change the mud flow rate through the whole drilling string, i.e. reduce mud circulation flow rate or increase the flow rate from the optimum flow rate.

Another way to change nozzle Total Flow Area (TFA) of the drill bit or other flow restrictor disposed within the conduit is to pull out the tubular string from the wellbore and replace the nozzle with another of the desired TFA.

A previously-described adjustable geometry nozzle requires the operator to pull the string out of the wellbore.

Changing mud flow rate from the optimum to adjust the HSI requires reducing mud circulation flow rate or increasing the flow rate from the optimum flow rate. This results in undesired annular flow velocity which causes deterioration in the hole cleaning efficiency through increase of suspended solids or cuttings within the wellbore or causing a washout when formation or other undesirable acts.

Pulling out the tubular string from the wellbore to replace the nozzle with another of the desired TFA cost the operator significant time and money and increase drilling risks.

One aspect of the current invention is to introduce methods and apparatus to remotely change the geometry of a drill bit nozzle which allows to adjust the HSI of the nozzle while maintaining optimum flow rate. Another aspect of the present invention is to introduce an apparatus and method for remotely and selectively changing flow profile within the tubular string or between the tubular string inner flow passage and annular flowpassage.

Maintenance of annular velocity and the introduction of adjustable TFA drill bit nozzles using the current invention will reduce the operating cost and risks associated with suspended solids or cuttings as well as risks associated with possible formation collapse.

Drill bit nozzles are made of fixed size, therefore drill bit manufacturers provide different drill bit designs with alternative number of nozzles and sizes. A typical nozzle (shown in FIG. 3) is inserted into an aperture, and is held in place by any one of several means, such as a snap ring, screw threads, or a nail lock. The inner diameter of the nozzle outlet is approximately equal to the opening above which. The final outlet internal diameter of the nozzle is measured in increments of 1/32 of an inch. To adjust the flow, the nozzle has to be replaced with another nozzle which has a different outlet inner diameter.

Replacing a drill bit nozzle requires pulling the drill string out of the hole (POH) which retards drilling operation and multiplies drilling cost. The size of nozzle needed cannot be determined in advance due to the many factors affecting nozzle sizing. Therefore, drill bits are commonly shipped off-shore with several nozzles with different sizes for each aperture. At the drilling site, the correct-size nozzle is installed whereas unused nozzles are normally discarded or lost which increases the cost and time of drilling.

In a more recently disclosed invention, a drill bit nozzle with adjustable orifice is proposed (shown in FIG. 4A). This design allows the same nozzle to deliver the mud at variable pressures. This is accomplished by the use of two thick plates, each having a shaped aperture therein. The degree to which the two apertures are overlapped determines the size of the orifice. The movement of at least one of the plates, and thus the size of the orifice, can be adjusted at the drill site, to give a desired pressure drop across the nozzle.

SUMMARY

In one example, disclosed is a nozzle adapted for use in a rotary drill bit for drilling a n earth borehole based on changing the environment in the borehole, the nozzle including: a body configured to be secured within the rotary drill bit, at least one fluid passage of variable geometry through the body for connecting a fluid through the body, an orifice disposed within the body, in fluid communication with the at least one fluid passage and the borehole, a means for changing the geometry of the at least one fluid passage having at least one movable element, in fluid communication with the fluid passage and the orifice, the at least one movable element is movable from an initial position to at least one other predetermined position in response to intended changes in the borehole environment.

In one example, the at least one moveable element is movable from an initial position to another predetermined position under normal fluid circulation (from the drill bit to the borehole), and the at least one moveable element is movable from an initial position to a different predetermined position under reverse fluid circulation (from the borehole to the drill bit).

In one example, the at least one moveable element is rotatable to a plurality of predetermined positions.

In one example, disclosed is an apparatus for remotely changing flow profile in conduit and rotary drill bit based on changing the environment in the borehole, the apparatus including: (a) a nozzle adapted for use in a rotary drill bit for drilling an earth borehole, the nozzle including: a body configured to be secured within the rotary drill bit, at least one fluid passage of variable geometry through the body for connecting a fluid through the body, an orifice disposed within the body, in fluid communication with the at least one fluid passage and the borehole, a means for changing the geometry of the at least one fluid passage having at least one movable element, in fluid communication with the fluid passage and the orifice, wherein the at least one movable element is movable from an initial position to at least one other predetermined position in response to intended changes in the borehole environment; (b) at least one means for detecting a plurality of intended changes in at least one physical property of the borehole environment resulting in a detectable signal within the apparatus for processing the signal; (c) a means for actuating the means for changing the geometry of the at least one fluid passage; and (d) a means for powering the means for actuating the at least movable element.

In one example, the at least one detecting means comprises a sensor.

In one example, the actuating means comprises an electric motor.

In one example, the actuating means comprises a movable rack, the rack mechanically engaged with the at least one movable element.

In one example, the powering means comprises an energy harvester.

In one example, the energy harvester is set to receive hydraulic energy from fluid flow in the tubular string and is configured to provide electrical energy to the means for actuating.

In one example, the energy harvester is set to receive hydraulic energy from a fluid pressure difference between the inner fluid passage and the wellbore fluid.

In one example, the energy harvester is set to receive thermal energy from a temperature difference between two points within the drill bit and is configured to provide electrical energy to the means for actuating.

In one example, the powering means comprises an energized resilient element.

In one example, the powering means comprises a battery.

In one set of examples, disclosed is a method for drilling an earth borehole based on changing the environment in the borehole, the method including: (a) disposing in a wellbore a drill bit attached to a tubular string, the drill bit including an apparatus, the apparatus comprising: a nozzle adapted for use in a rotary drill bit for drilling an earth borehole, the nozzle comprising: a body configured to be secured within the rotary drill bit, at least one fluid passage of variable geometry through the body for connecting a fluid through the body, an orifice disposed within the body, in fluid communication with the at least one fluid passage and the borehole, a means for changing the geometry of the at least one fluid passage having at least one movable element, in fluid communication with the fluid passage and the orifice, the at least one movable element is movable from an initial position to at least one other predetermined position in response to intended changes in the borehole environment; at least one means for detecting a plurality of intended changes in at least one physical property of the borehole environment resulting in a detectable signal within the apparatus for processing the signal; a means for actuating the means for changing the geometry of the at least one fluid passage; a means for powering the means for actuating the at least movable element; (b) causing a change in at least one physical property within the borehole environment in certain sequence within a specified period of time resulting in a detectable pattern at the at least one detecting means; and (c) causing the actuating means to use the energy provided by the powering means to change the geometry of the at least one fluid passage within the nozzle.

In one example, the change in a physical property of the environment is a mechanical movement of the apparatus by means of moving the tubular string, causing the apparatus to move within the wellbore in at least one direction detectable by the detecting means.

In one example, the change of physical property includes a change in one or more of the following fluid properties: pressure, temperature, flow rate, density, viscosity, color, and composition, detectable by the detecting means.

In one example, the change in a physical property includes a change in one or more of the following physical properties: electromagnetic, electrostatic, and seismic, detectable by the detecting means.

In one example, changing the geometry of the at least one fluid passage includes reducing the area of the nozzle orifice to increase the velocity of the nozzle jet.

In one example, changing the geometry of the at least one fluid passage includes increasing the area of the nozzle orifice to decrease the velocity of the nozzle jet.

In one example, the change of physical property includes a change in the direction of flow circulation.

In one example, changing the geometry of the at least one fluid passage includes moving the at least one movable element from a first position to a second position when the flow is circulated in one direction and moving the at least one movable element from the second position to the first position when the flow is circulated in the opposite direction.

In one example, the apparatus may further include a cam and a latch to hold the at least one movable element in a position resulting in the desired change of the geometry of the at least one fluid passage and allowing the flow circulation to be changed.

In one example, the actuating means includes an actuator selected from at least one of a rack-type actuator, an electric motor, a solenoid, and a cam-type actuator.

In one example, the rack-type actuator includes at least one rack, and actuating the means for changing the geometry of the at least one fluid passage includes moving the rack between a first position and a second position.

In one example, the powering means includes a power source selected from at least one of a hydraulic power, an energized resilient element, a battery, a super capacitor, and an energy harvester.

In one example, the energy harvester is selected from at least one of an electromagnetic induction harvester, a piezoelectric harvester, and a thermoelectric harvester.

In one example, the hydraulic power includes creating a net pressure force on the surfaces of the movable element exposed to the fluid passing through the nozzle.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DETAILED DESCRIPTION

U.S. Provisional Application No. 61/710,887, filed Oct. 8, 2012 for METHOD AND APPARATUS TO CONTROL THE MUD FLOW IN DRILL STRINGS AND WELLBORE ANNULUS 156, by Ahmed TAHOUN, Raed Kafafy, Karam Jawamir, Mohamed Aldheeb, Abdul Mushawwir Mohamad Khalil is herein incorporated by reference in its entirety.

U.S. Provisional Application No. 61/622,572, filed Apr. 11, 2012 for METHOD AND APPARATUS OF CONTROL DRILLING FLUID LOSSES AND IMPROVED HOLE CLEANING IN OIL & GAS SUBTERRANEAN DRILLING OPERATIONS, by Ahmed Moustafa Tahoun is herein incorporated by reference in its entirety.

U.S. Provisional Application No. 61/710,823, filed Oct. 8, 2012 for METHOD AND APPARATUS TO HARVEST ENERGY INSIDE WELLBORE 100 FROM CHANGE OF FLUID FLOW RATE, by Ahmed M. Tahoun, Raed I. Kafafy, Karam Jawamir, Mohamed A. Aldheeb, Abdul M. Khalil is herein incorporated by reference in its entirety. U.S. Provisional Application No. 61/648,575, filed May 17, 2012 for Method and Apparatus to remotely change the area of drill bit 120 nozzles and drill string flow restrictors, by Ahmed M. Tahoun, Raed I. Kafafy, Karam Jawamir, Mohamed A. Aldheeb is herein incorporated by reference in its entirety.

U.S. application Ser. No. 13/846,946, filed Mar. 18, 2013 for Apparatus and method to remotely control fluid flow in tubular strings and wellbore annulus 156, by Ahmed M. Tahoun, Raed I. Kafafy, Karam Jawamir, Mohamed A. Aldheeb, Abdul M Khalil is herein incorporated by reference in its entirety. U.S. application Ser. No. 13/861,255, filed Apr. 11, 2013 for Apparatus and method to remotely control fluid flow in tubular strings and wellbore annulus 156, by Ahmed M. Tahoun, Raed I. Kafafy, Karam Jawamir, Mohamed A. Aldheeb, Abdul M Khalil is herein incorporated by reference in its entirety.

Figure 1:
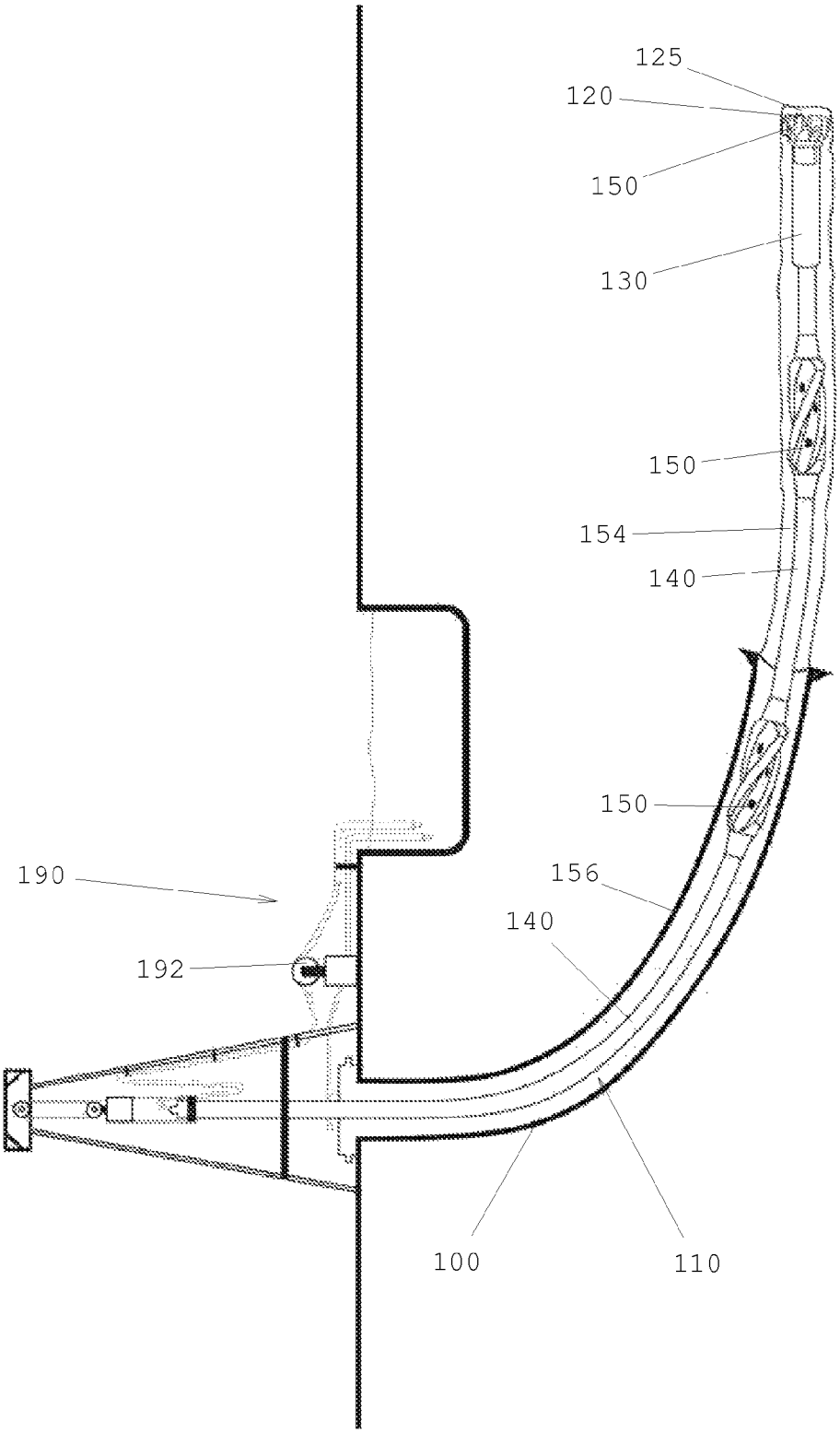
FIG. 1 is a section view of a possible embodiment of a wellbore drilling system wherein a plurality of the fluid flow control apparatus are disposed within drilling tubular string.

FIG. 1 is a section view of an example of a wellbore 100 drilling system wherein a plurality of the variable geometry nozzle 150 are disposed within the drilling tubular string 110 during the well forming operation. The majority of drilling systems used in current days include a tubular string 110 composed of a drill bit 120 having at least one perforation 125 located through the drill bit 120 to allow fluid flow through. A heavy tubular with a bigger outer diameter, among other equipment such as mud motors or logging while drilling equipment or directional drilling control systems, or any combination thereof, that may be referred to as a bottom hole assembly 130 may be connected to the drill bit 120 from one end. Bottom hole assembly 130 is normally connected in the form of a thread from the other end to another tubular string 110, such as a drill pipe 140 connecting the bottom hole assembly 130 to the surface. The drill pipe 140 outer diameter is commonly known to be smaller when compared to the bottom hole assembly 130. A plurality of variable geometry nozzles 150 disposed within the wellbore 100 are connected to a portion of the tubular string 110 by a suitable means, normally a form of thread. The wellbore 100 formed into the earth may have a deviated section where the wellbore 100 is not vertical. A cased hole section is the portion of the wellbore 100 having a tubular of large diameter, called casing, lining the inner side of the wellbore 100 to protect wellbore 100 from damage. While drilling a deeper section into earth formations an open hole section of the wellbore 100 is formed. A surface mud pump system 190 is disposed with most drilling operations and includes a drilling fluid tank to store drilling fluid and a pump 192 to force fluid into the inner flow passage 152, defined as the inner space within the tubular string 110. Cuttings generated from hole making are carried out through the annular flow passage 154. An annular flow passage 154 is defined as the space between the inner wall of the wellbore 100 and the outer wall of the tubular string 110. The variable geometry nozzle 150 is disposed inside perforation 125 or an opening within the drill bit 120.

Figure 2:
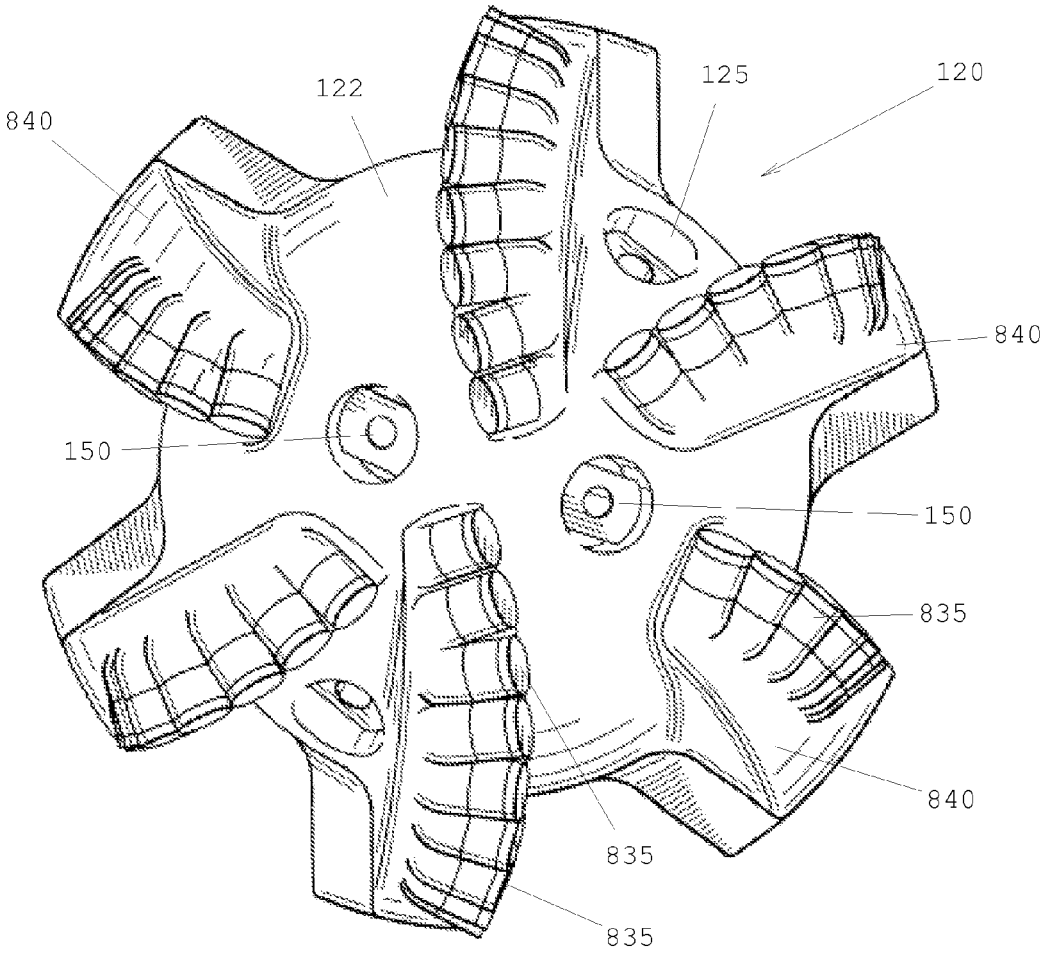
FIG. 2 is a bottom view of an example of drill bit comprises at least one nozzle port.

FIG. 2 is a bottom view of a typical drill bit 120 used in modern drilling activity. Drill bit 120 comprises a drill bit body 122, one or more bit cutters 835 disposed on a bit outer surface and attached to at least one bit blade 840 suitably arranged to perform the cutting action when made to interact with an earth formation during a drilling operation. One or more perforations 125 is disposed on the bit body 200 in communication between the inner flow passage 152 and the annular flow passage 154. A flow restrictor, commonly known as bit nozzle is normally disposed within the bit perforation 125. In one example at least one variable geometry nozzle 150 is disposed in bit perforation 125.

Figure 3:
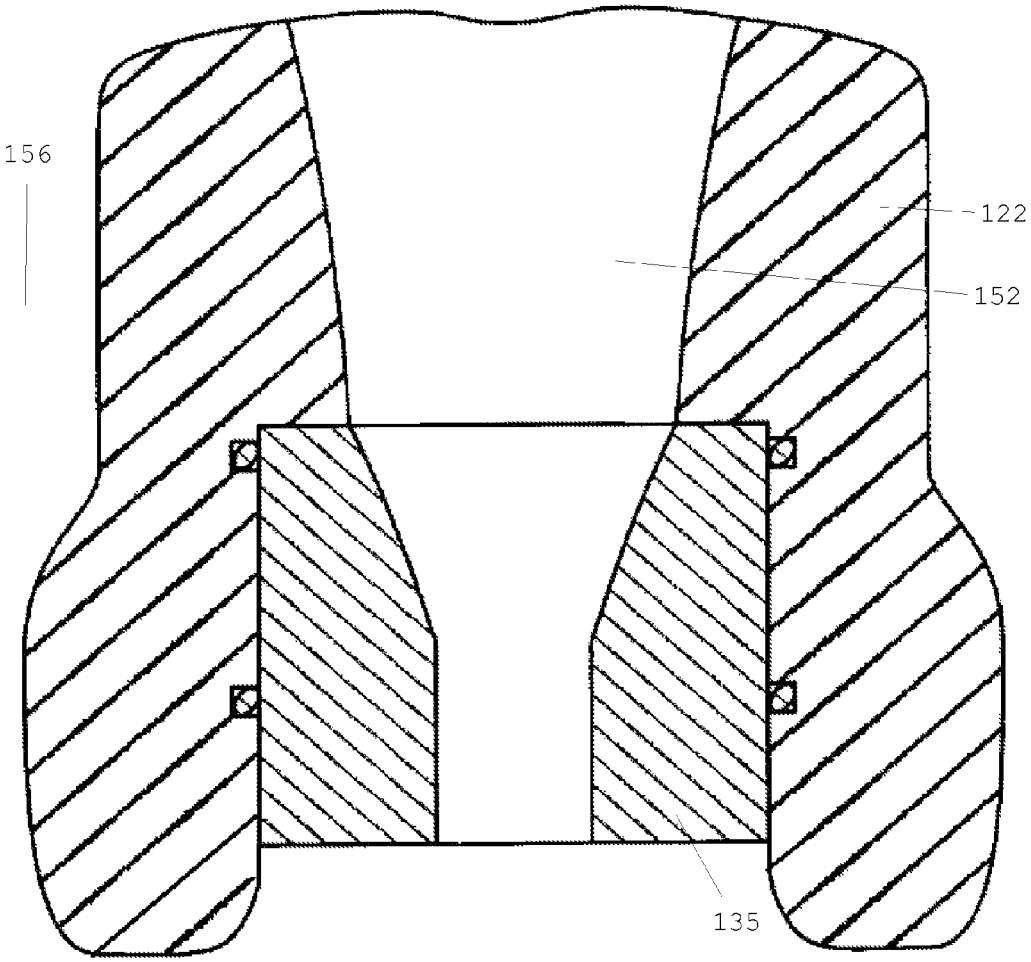
FIG. 3 is a section view of a drill bit with conventional nozzle disposed in one port.

FIG. 3 is a section view of a drill bit 120 with conventional nozzle 135 disposed in one perforation 125 within drill bit body 122 connecting inner flow passage 152 to the annular flow passage 154. The conventional nozzle 135 has a fixed geometry and cannot be changed except when brought out to surface.

Referring generally to FIGS. 4A-4H, FIGS. 4A-4H are detailed section views of an example set of possible configurations of a variable geometry nozzle 150 showing a movable element 400 in different positions.

Figure 4A:
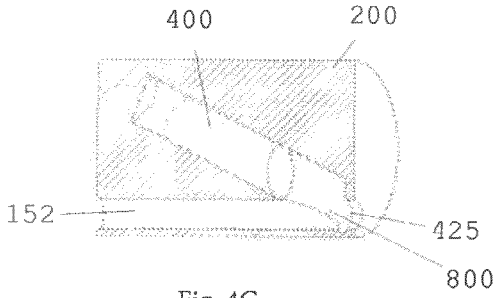
FIG. 4A is a detailed section view of one of an example set of possible configurations of a variable geometry nozzle showing a movable element in different positions.

FIG. 4A is a section view of one example of the variable geometry nozzle 150 comprising a body 200, a movable element 400 disposed within the body 200 in one position where the flow geometry 440 generated by interaction of the movable element 400 and the inner flow passage 152 is of specific geometry when the movable element 400 is in this position. The inner flow passage 152 is connected to the orifice 425 through a downstream passage 800. The downstream passage 800 is the location within the variable geometry nozzle 150 where the movable element 400 interact with inner flow passage 152 causing a change in the inner flow passage 152 geometry and causing the variable geometry nozzle 150 to have a specific flow geometry 440 and specific to the movable element 400 shape.

Figure 4B:
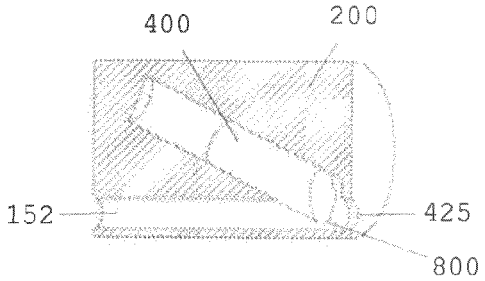
FIG. 4B is a detailed section view of one of an example set of possible configurations of a variable geometry nozzle showing a movable element in different positions.

FIG. 4B is a section view of one example of the variable geometry nozzle 150 explained in the description of FIG. 4A where the movable element 400 is in a different position interacting with the inner flow passage 152 causing a change of the flow passage geometry when compared to the flow passage geometry of FIG. 4A.

Figure 4C:
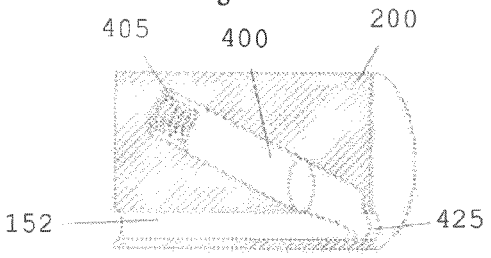
FIG. 4C is a detailed section view of one of an example set of possible configurations of a variable geometry nozzle showing a movable element in different positions.

FIG. 4C is a section view of one example of the variable geometry nozzle 150 comprising a body 200, a movable element 400 disposed within the body 200 in one position where the flow geometry 440 generated by interaction of the movable element 400 and the inner flow passage 152 is of specific geometry when the movable element 400 is in this position. The inner flow passage 152 is connected to the orifice 425 through a downstream passage 800. The downstream passage 800 is the location within the variable geometry nozzle 150 where the movable element 400 interact with inner flow passage 152 causing a change in the inner flow passage 152 geometry and causing the variable geometry nozzle 150 to have a specific flow geometry 440 and specific to the movable element 400 shape. In this example a resilient element 405 is attached to the movable element 400 causing it to be biased in specific direction.

Figure 4D:
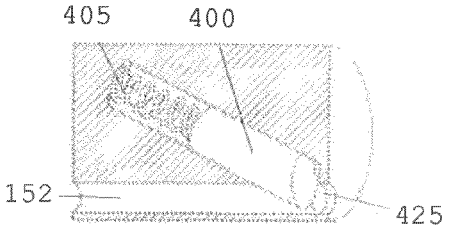
FIG. 4D is a detailed section view of one of an example set of possible configurations of a variable geometry nozzle showing a movable element in different positions.

FIG. 4D is a section view of one example of the variable geometry nozzle 150 explained in the description of FIG. 4C where the movable element 400 is in a different position interacting with the inner flow passage 152 causing a change of the flow passage geometry when compared to the flow passage geometry of FIG. 4C.

Figure 4E:
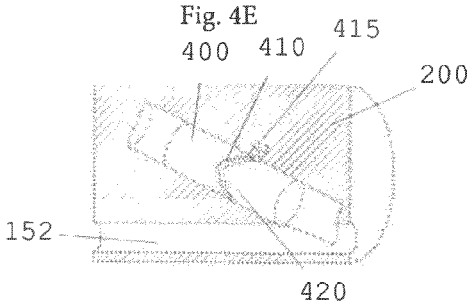
FIG. 4E is a detailed section view of one of an example set of possible configurations of a variable geometry nozzle showing a movable element in different positions.

FIG. 4E is a section view of one example of the variable geometry nozzle 150 comprising a body 200, a movable element 400 disposed within the body 200 in one position where the flow geometry 440 generated by interaction of the movable element 400 and the inner flow passage 152 is of specific geometry when the movable element 400 is in this position. The inner flow passage 152 is connected to the orifice 425 through a downstream passage 800. The downstream passage 800 is the location within the variable geometry nozzle 150 where the movable element 400 interact with inner flow passage 152 causing a change in the inner flow passage 152 geometry and causing the variable geometry nozzle 150 to have a specific flow geometry 440 and specific to the movable element 400 shape. In this example a suitable cam 420 similar to those explained in U.S. patent application Ser. Nos. 13/846,946 and 13/861,255, is attached to the movable element 400. A cam follower 415 disposed within the body 200 traverse the cam track 410 disposed on the cam 420 surface to control the movement of the movable element 400 and restrict it to certain distance and in certain direction.

Figure 4F:
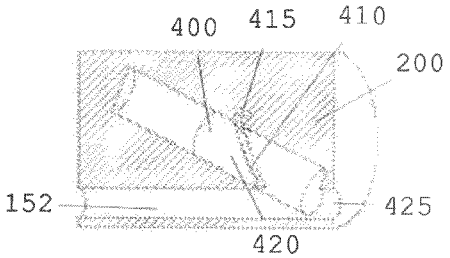
FIG. 4F is a detailed section view of one of an example set of possible configurations of a variable geometry nozzle showing a movable element in different positions.

FIG. 4F is a section view of one example of the variable geometry nozzle 150 explained in the description of FIG. 4E where the movable element 400 is in a different position interacting with the inner flow passage 152 causing a change of the flow passage geometry when compared to the flow passage geometry of FIG. 4E.

Figure 4G:
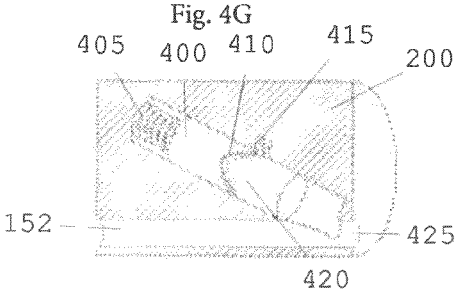
FIG. 4G is a detailed section view of one of an example set of possible configurations of a variable geometry nozzle showing a movable element in different positions.
Figure 4H:
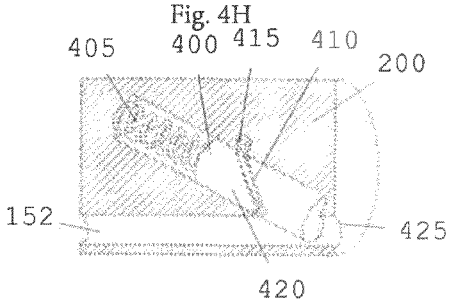
FIG. 4H is a detailed section view of one of an example set of possible configurations of a variable geometry nozzle showing a movable element in different positions.

FIG. 4G is a section view of one example of the variable geometry nozzle 150 comprising a body 200, a movable element 400 disposed within the body 200 in one position where the flow geometry 440 generated by interaction of the movable element 400 and the inner flow passage 152 is of specific geometry when the movable element 400 is in this position. The inner flow passage 152 is connected to the orifice 425 through a downstream passage 800. The downstream passage 800 is the location within the variable geometry nozzle 150 where the movable element 400 interact with inner flow passage 152 causing a change in the inner flow passage 152 geometry and causing the variable geometry nozzle 150 to have a specific flow geometry 440 and specific to the movable element 400 shape. In this example a resilient element 405 is attached to the movable element 400 causing it to be biased in specific direction and a suitable cam 420 similar to those explained in U.S. patent application Ser. Nos. 13/846,946 and 13/861,255 is attached to the movable element 400. A cam follower 415 disposed within the body 200 traverse the cam track 410 disposed on the cam 420 surface to control the movement of the movable element 400 and restrict it to certain distance and in certain direction. FIG. 4H is a section view of one example of the variable geometry nozzle 150 explained in the description of FIG. 4G where the movable element 400 is in a different position interacting with the inner flow passage 152 causing a change of the flow passage geometry when compared to the flow passage geometry of FIG. 4G.

Referring generally to FIGS. 5A-5H, FIGS. 5A-5H are detailed section views of an example set of possible configurations of a variable geometry nozzle 150 showing a movable element 400 in different positions. In this set of examples a movement communication duct 430 is disposed within the body 200 in fluid communication on one side with the movable element 400 and on another side in communication with the inner flow passage 152.

Figure 5A:
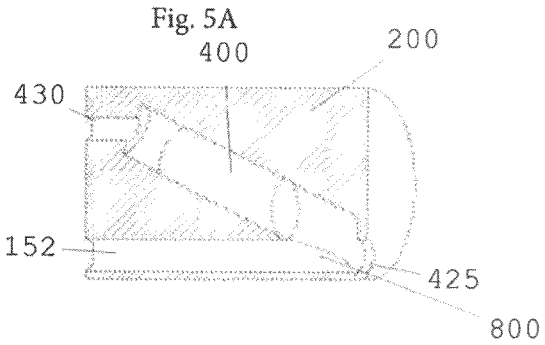
FIG. 5A is a detailed section view of one of an example set of possible configurations of a variable geometry nozzle showing a movable element in different positions.

FIG. 5A is a section view of one example of the variable geometry nozzle 150 comprising a body 200, a movable element 400 disposed within the body 200 in one position where the flow geometry 440 generated by interaction of the movable element 400 and the inner flow passage 152 is of specific geometry when the movable element 400 is in this position. The inner flow passage 152 is connected to the orifice 425 through a downstream passage 800. The downstream passage 800 is the location within the variable geometry nozzle 150 where the movable element 400 interact with inner flow passage 152 causing a change in the inner flow passage 152 geometry and causing the variable geometry nozzle 150 to have a specific flow geometry 440 and specific to the movable element 400 shape. In this example a movement communication duct 430 is disposed within the body 200 in fluid communication on one side with the movable element 400 and on another side in communication with the inner flow passage 152.

Figure 5B:
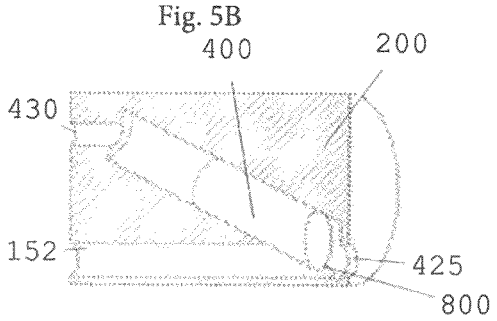
FIG. 5B is a detailed section view of one of an example set of possible configurations of a variable geometry nozzle showing a movable element in different positions.

FIG. 5B is a section view of one example of the variable geometry nozzle 150 explained in the description of FIG. 5A where the movable element 400 is in a different position interacting with the inner flow passage 152 causing a change of the flow passage geometry when compared to the flow passage geometry of FIG. 5A.

Figure 5C:
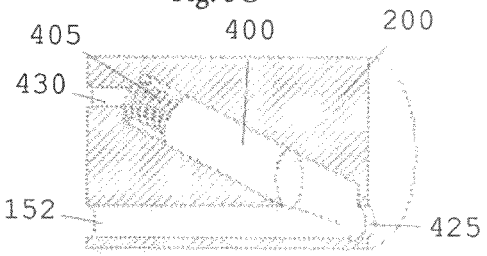
FIG. 5C is a detailed section view of one of an example set of possible configurations of a variable geometry nozzle showing a movable element in different positions.

FIG. 5C is a section view of one example of the variable geometry nozzle 150 comprising a body 200, a movable element 400 disposed within the body 200 in one position where the flow geometry 440 generated by interaction of the movable element 400 and the inner flow passage 152 is of specific geometry when the movable element 400 is in this position. The inner flow passage 152 is connected to the orifice 425 through a downstream passage 800. The downstream passage 800 is the location within the variable geometry nozzle 150 where the movable element 400 interact with inner flow passage 152 causing a change in the inner flow passage 152 geometry and causing the variable geometry nozzle 150 to have a specific flow geometry 440 and specific to the movable element 400 shape. In this example a resilient element 405 is attached to the movable element 400 causing it to be biased in specific direction. In this example a movement communication duct 430 is disposed within the body 200 in fluid communication on one side with the movable element 400 and on another side in communication with the inner flow passage 152.

Figure 5D:
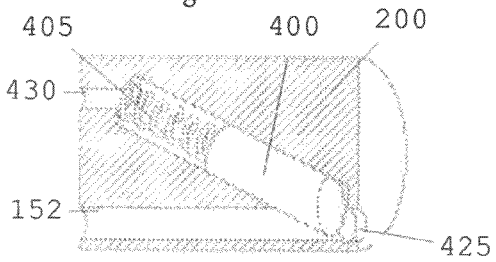
FIG. 5D is a detailed section view of one of an example set of possible configurations of a variable geometry nozzle showing a movable element in different positions.

FIG. 5D is a section view of one example of the variable geometry nozzle 150 explained in the description of FIG. 5C where the movable element 400 is in a different position interacting with the inner flow passage 152 causing a change of the flow passage geometry when compared to the flow passage geometry of FIG. 5C.

Figure 5E:
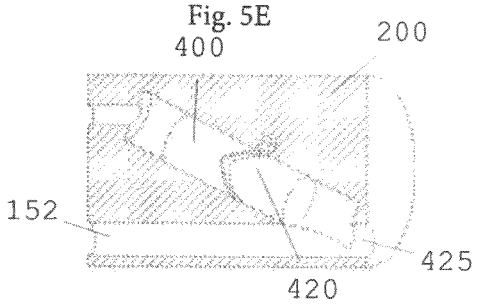
FIG. 5E is a detailed section view of one of an example set of possible configurations of a variable geometry nozzle showing a movable element in different positions.

FIG. 5E is a section view of one example of the variable geometry nozzle 150 comprising a body 200, a movable element 400 disposed within the body 200 in one position where the flow geometry 440 generated by interaction of the movable element 400 and the inner flow passage 152 is of specific geometry when the movable element 400 is in this position. The inner flow passage 152 is connected to the orifice 425 through a downstream passage 800. The downstream passage 800 is the location within the variable geometry nozzle 150 where the movable element 400 interact with inner flow passage 152 causing a change in the inner flow passage 152 geometry and causing the variable geometry nozzle 150 to have a specific flow geometry 440 and specific to the movable element 400 shape. In this example a suitable cam 420 similar to those explained in U.S. patent application Ser. Nos. 13/846,946 and 13/861,255 is attached to the movable element 400. A cam follower 415 disposed within the body 200 traverse the cam track 410 disposed on the cam 420 surface to control the movement of the movable element 400 and restrict it to certain distance and in certain direction. In this example a movement communication duct 430 is disposed within the body 200 in fluid communication on one side with the movable element 400 and on another side in communication with the inner flow passage 152.

Figure 5F:
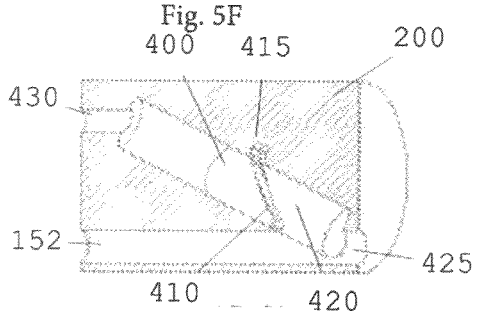
FIG. 5F is a detailed section view of one of an example set of possible configurations of a variable geometry nozzle showing a movable element in different positions.

FIG. 5F is a section view of one example of the variable geometry nozzle 150 explained in the description of FIG. 5E where the movable element 400 is in a different position interacting with the inner flow passage 152 causing a change of the flow passage geometry when compared to the flow passage geometry of FIG. 5E.

Figure 5G:
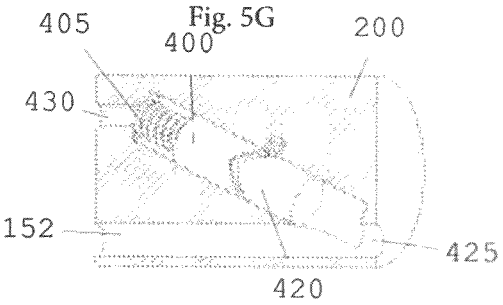
FIG. 5G is a detailed section view of one of an example set of possible configurations of a variable geometry nozzle showing a movable element in different positions.

FIG. 5G is a section view of one example of the variable geometry nozzle 150 comprising a body 200, a movable element 400 disposed within the body 200 in one position where the flow geometry 440 generated by interaction of the movable element 400 and the inner flow passage 152 is of specific geometry when the movable element 400 is in this position. The inner flow passage 152 is connected to the orifice 425 through a downstream passage 800. The downstream passage 800 is the location within the variable geometry nozzle 150 where the movable element 400 interact with inner flow passage 152 causing a change in the inner flow passage 152 geometry and causing the variable geometry nozzle 150 to have a specific flow geometry 440 and specific to the movable element 400 shape. In this example a resilient element 405 is attached to the movable element 400 causing it to be biased in specific direction and a suitable cam 420 similar to those explained in U.S. patent application Ser. Nos. 13/846,946 and 13/861,255, is attached to the movable element 400. A cam follower 415 disposed within the body 200 traverse the cam track 410 disposed on the cam 420 surface to control the movement of the movable element 400 and restrict it to certain distance and in certain direction. In this example a movement communication duct 430 is disposed within the body 200 in fluid communication on one side with the movable element 400 and on another side in communication with the inner flow passage 152.

Figure 5H:
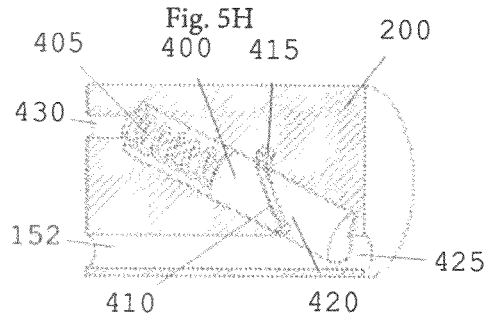
FIG. 5H is a detailed section view of one of an example set of possible configurations of a variable geometry nozzle showing a movable element in different positions.

FIG. 5H is a section view of one example of the variable geometry nozzle 150 explained in the description of FIG. 5G where the movable element 400 is in a different position interacting with the inner flow passage 152 causing a change of the flow passage geometry when compared to the flow passage geometry of FIG. 5G.

Referring generally to FIGS. 6A-6D, FIGS. 6A-6D are detailed section views of an example set of possible configurations of a variable geometry nozzle 150 showing a movable element 400 in different positions.

Figure 6A:
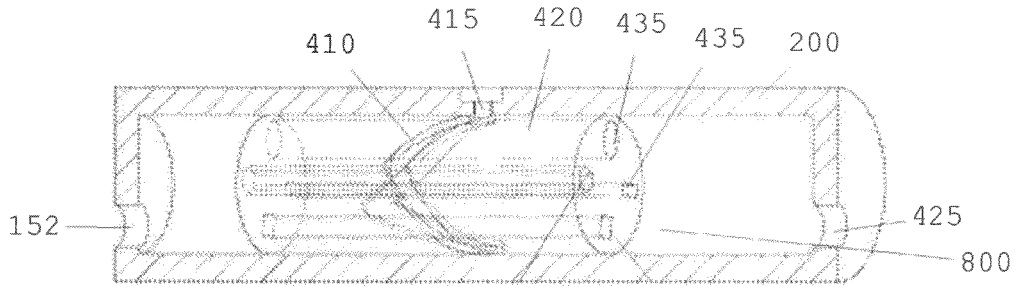
FIG. 6A is a detailed section view of one of an example set of possible configurations of a variable geometry nozzle showing a movable element in different positions.

FIG. 6A is an example of the variable geometry nozzle 150 comprising a body 200, a movable element 400 disposed within the body 200 having plurality of movable element geometry orifice 435(*s*) in one position; similar to those explained in U.S. Patent application Ser. Nos. 13/846,946 and 13/861,255 is attached to the movable element 400. A cam follower 415 disposed within the body 200 traverse the cam track 410 disposed on the cam 420 surface to control the movement of the movable element 400 and restrict it to certain distance and in certain direction. In this example the movable element 400 is in a specific position such that at least one movable element geometry orifice 435 is in fluid communication with the inner flow passage 152 from one side and the orifice 425 on another side resulting in a specific flow geometry 440 of the downstream passage 800.

Figure 6B:
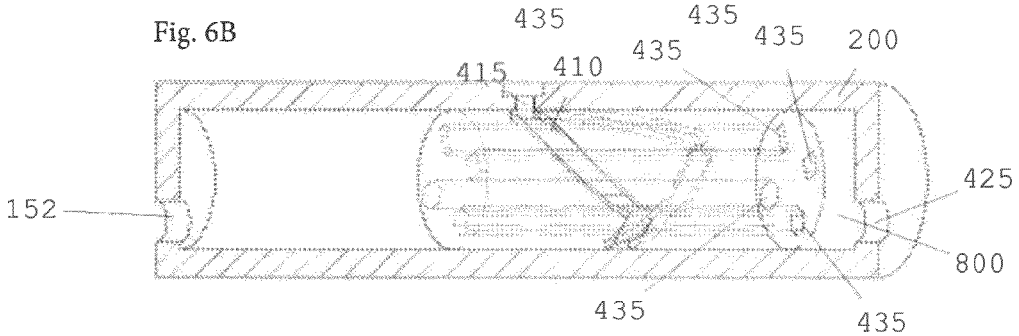
FIG. 6B is a detailed section view of one of an example set of possible configurations of a variable geometry nozzle showing a movable element in different positions.

FIG. 6B is a section view of one example of the variable geometry nozzle 150 explained in the description of FIG. 6A where the movable element 400 is in a different position interacting with the inner flow passage 152 such that a different movable element geometry orifice 435 is in communication with the inner flow passage 152 causing a change of the flow passage geometry when compared to the flow passage geometry of FIG. 5A.

Figure 6C:
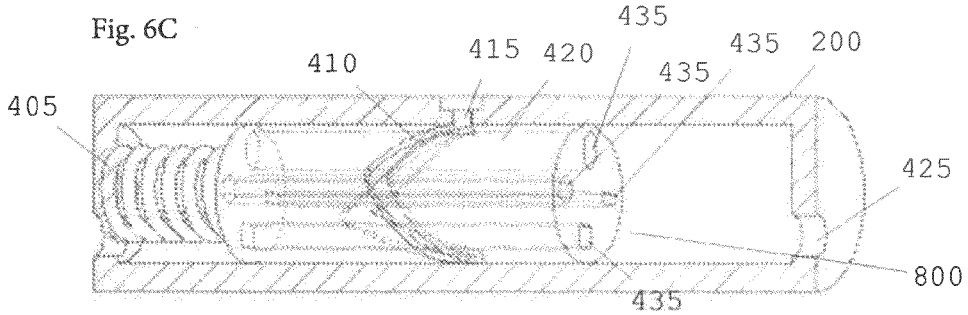
FIG. 6C is a detailed section view of one of an example set of possible configurations of a variable geometry nozzle showing a movable element in different positions.

FIG. 6C is an example of the variable geometry nozzle 150 comprising a body 200, a movable element 400 disposed within the body 200 having plurality of movable element geometry orifice 435(*s*) in one position; similar to those explained in U.S. patent application Ser. Nos. 13/846,946 and 13/861,255 is attached to the movable element 400. A cam follower 415 disposed within the body 200 traverse the cam track 410 disposed on the cam 420 surface to control the movement of the movable element 400 and restrict it to certain distance and in certain direction. In this example the movable element 400 is in specific position such that at least one movable element geometry orifice 435 is in fluid communication with the inner flow passage 152 from one side and the orifice 425 on another side resulting in a specific flow geometry 440 of the downstream passage 800. In this example a resilient element 405 is attached to the movable element 400 causing it to be biased in specific direction. In another example, the resilient element 405 is arranged from the side in connection with the movable element 400 such that at least one movable element geometry orifice 435 is restricted from communication with the inner flow passage 152.

Figure 6D:
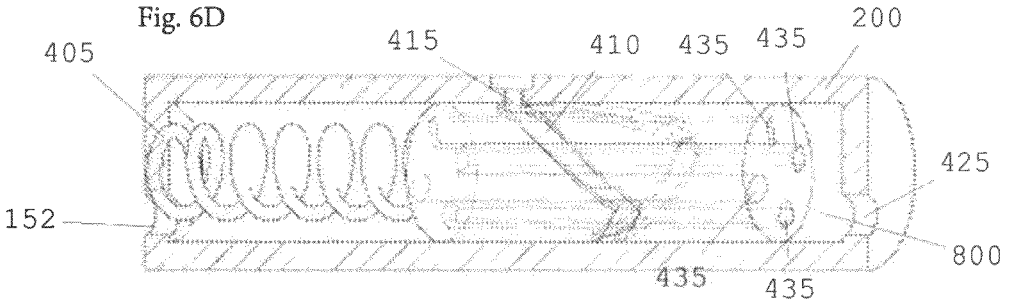
FIG. 6D is a detailed section view of one of an example set of possible configurations of a variable geometry nozzle showing a movable element in different positions.

FIG. 6D is a section view of one example of the variable geometry nozzle 150 explained in the description of FIG. 6C where the movable element 400 is in a different position interacting with the inner flow passage 152 such that a different movable element geometry orifice 435 is in communication with the inner flow passage 152 causing a change of the flow passage geometry when compared to the flow passage geometry of FIG. 5C.

Figure 7A:
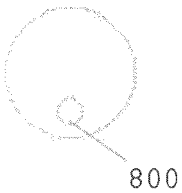
FIG. 7A is a detailed section view of one of an example set of possible configurations of a variable geometry nozzle showing a movable element having different shapes of movable element geometry orifice in different positions.
Figure 7B:
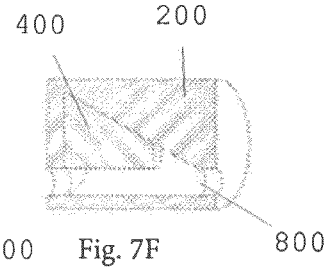
FIG. 7B is a detailed section view of one of an example set of possible configurations of a variable geometry nozzle showing a movable element having different shapes of movable element geometry orifice in different positions.
Figure 7C:
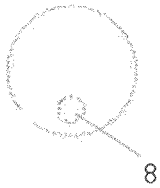
FIG. 7C is a detailed section view of one of an example set of possible configurations of a variable geometry nozzle showing a movable element having different shapes of movable element geometry orifice in different positions.
Figure 7D:
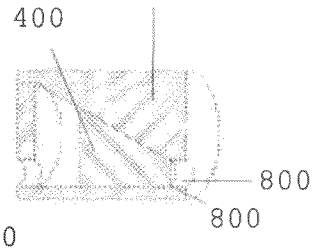
FIG. 7D is a detailed section view of one of an example set of possible configurations of a variable geometry nozzle showing a movable element having different shapes of movable element geometry orifice in different positions.
Figure 7E:
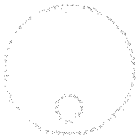
FIG. 7E is a detailed section view of one of an example set of possible configurations of a variable geometry nozzle showing a movable element having different shapes of movable element geometry orifice in different positions.
Figure 7F:
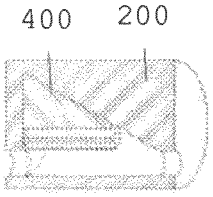
FIG. 7F is a detailed section view of one of an example set of possible configurations of a variable geometry nozzle showing a movable element having different shapes of movable element geometry orifice in different positions.
Figure 7G:
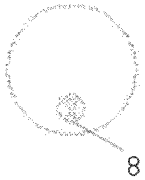
FIG. 7G is a detailed section view of one of an example set of possible configurations of a variable geometry nozzle showing a movable element having different shapes of movable element geometry orifice in different positions.
Figure 7H:
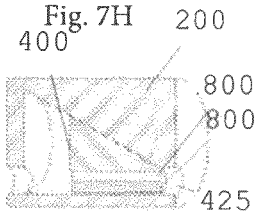
FIG. 7H is a detailed section view of one of an example set of possible configurations of a variable geometry nozzle showing a movable element having different shapes of movable element geometry orifice in different positions.
Figure 7I:
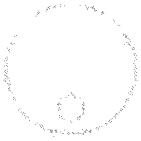
FIG. 7I is a detailed section view of one of an example set of possible configurations of a variable geometry nozzle showing a movable element having different shapes of movable element geometry orifice in different positions.
Figure 7J:
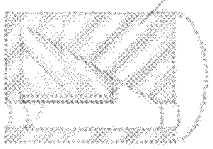
FIG. 7J is a detailed section view of one of an example set of possible configurations of a variable geometry nozzle showing a movable element having different shapes of movable element geometry orifice in different positions.
Figure 7K:
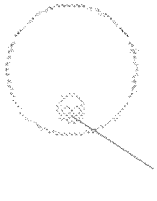
FIG. 7K is a detailed section view of one of an example set of possible configurations of a variable geometry nozzle showing a movable element having different shapes of movable element geometry orifice in different positions.
Figure 7L:
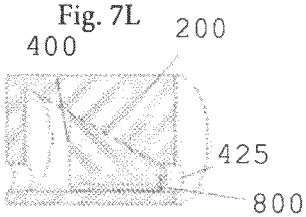
FIG. 7L is a detailed section view of one of an example set of possible configurations of a variable geometry nozzle showing a movable element having different shapes of movable element geometry orifice in different positions.
Figure 7M:
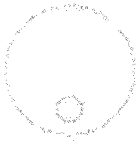
FIG. 7M is a detailed section view of one of an example set of possible configurations of a variable geometry nozzle showing a movable element having different shapes of movable element geometry orifice in different positions.
Figure 7N:
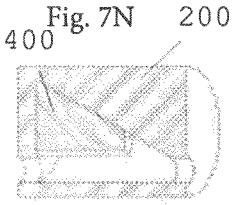
FIG. 7N is a detailed section view of one of an example set of possible configurations of a variable geometry nozzle showing a movable element having different shapes of movable element geometry orifice in different positions.
Figure 7O:
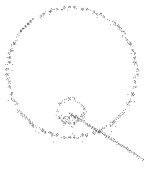
FIG. 7O is a detailed section view of one of an example set of possible configurations of a variable geometry nozzle showing a movable element having different shapes of movable element geometry orifice in different positions.
Figure 7P:
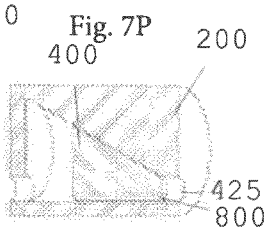
FIG. 7P is a detailed section view of one of an example set of possible configurations of a variable geometry nozzle showing a movable element having different shapes of movable element geometry orifice in different positions.
Figure 7Q:
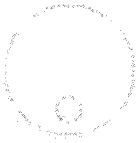
FIG. 7Q is a detailed section view of one of an example set of possible configurations of a variable geometry nozzle showing a movable element having different shapes of movable element geometry orifice in different positions.
Figure 7R:
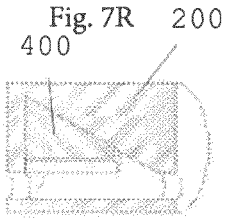
FIG. 7R is a detailed section view of one of an example set of possible configurations of a variable geometry nozzle showing a movable element having different shapes of movable element geometry orifice in different positions.
Figure 7S:
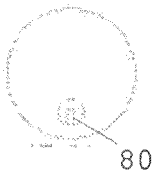
FIG. 7S is a detailed section view of one of an example set of possible configurations of a variable geometry nozzle showing a movable element having different shapes of movable element geometry orifice in different positions.
Figure 7T:
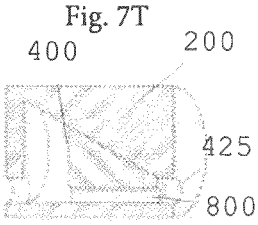
FIG. 7T is a detailed section view of one of an example set of possible configurations of a variable geometry nozzle showing a movable element having different shapes of movable element geometry orifice in different positions.

Referring generally to FIGS. 7A-7T, FIGS. 7A-7T are detailed section views of an example set of possible configurations of a variable geometry nozzle 150 showing a movable element 400 having different shapes of movable element geometry orifice 435 in different positions.

FIG. 7A is a side view of the variable geometry nozzle 150 wherein the movable element 400 is in one position shown in the cross section view described in FIG. 7B.

FIG. 7B is a section view of an example set of possible configurations of variable geometry nozzle 150 showing movable element 400 having a movable element geometry orifice 435 in one position such that inner flow passage 152 is in free communication with the orifice 425 through the downstream passage 800.

FIG. 7C is a side view of the variable geometry nozzle 150 wherein the movable element 400 is in a different position described in FIG. 7D showing a restricted downstream passage FIG. 7D is a section view of the variable geometry nozzle 150 described in FIG. 7B wherein the movable element 400 is in different position when compared to the position described in FIG. 7B. In this figure the downstream passage 800 is restricted due to the shape of the movable element 400 flow orifice 425 and the interaction of the movable element 400 with the inner flow passage 152 in this position.

FIG. 7E is a side view of the variable geometry nozzle 150 wherein the movable element 400 is in one position shown in the cross section view described in FIG. 7F.

FIG. 7F is a section view of an example set of possible configurations of variable geometry nozzle 150 showing movable element 400 having a movable element geometry orifice 435 in one position such that inner flow passage 152 is in free communication with the orifice 425 through the downstream passage 800.

FIG. 7G is a side view of the variable geometry nozzle 150 wherein the movable element 400 is in a different position described in FIG. 7H showing a restricted downstream passage.

FIG. 7H is a section view of the variable geometry nozzle 150 described in FIG. 7F wherein the movable element 400 is in different position when compared to the position described in FIG. 7F. In this figure the downstream passage 800 is having a shape of two rounded openings wherein the movable element 400 flow orifice 425 (*s*) are in communication with the inner flow passage 152 on one side and to the orifice 425 on the other side.

FIG. 7I is a side view of the variable geometry nozzle 150 wherein the movable element 400 is in one position shown in the cross section view described in FIG. 7J.

FIG. 7J is a section view of an example of a possible configurations of variable geometry nozzle 150 showing movable element 400 having a movable element geometry orifice 435 in one position such that inner flow passage 152 is in free communication with the orifice 425 through the downstream passage 800.

FIG. 7K is a side view of the variable geometry nozzle 150 wherein the movable element 400 is in a different position described in FIG. 7L showing a restricted downstream passage.

FIG. 7L is a section view of the variable geometry nozzle 150 described in FIG. 7J wherein the movable element 400 is in different position when compared to the position described in FIG. 7J. In this figure the downstream passage 800 is having a shape of three rounded openings wherein the movable element 400 flow orifice 425 (*s*) are in communication with the inner flow passage 152 on one side and to the orifice 425 on the other side.

FIG. 7M is a side view of the variable geometry nozzle 150 wherein the movable element 400 is in one position shown in the cross section view described in FIG. 7N.

FIG. 7N is a section view of an example of a possible configurations of variable geometry nozzle 150 showing movable element 400 having a movable element geometry orifice 435 in one position such that inner flow passage 152 is in free communication with the orifice 425 through the downstream passage 800.

FIG. 7O is a side view of the variable geometry nozzle 150 wherein the movable element 400 is in a different position described in FIG. 7P showing a restricted downstream passage 800.

FIG. 7P is a section view of the variable geometry nozzle 150 described in FIG. 7N wherein the movable element 400 is in different position when compared to the position described in FIG. 7N. In this figure the downstream passage 800 is having a shape of curved opening wherein the movable element 400 flow orifice 425 is in communication with the inner flow passage 152 on one side and to the orifice 425 on the other side.

FIG. 7Q is a side view of the variable geometry nozzle 150 wherein the movable element 400 is in one position shown in the cross section view described in FIG. 7R.

FIG. 7R is a section view of an example of a possible configurations of variable geometry nozzle 150 showing movable element 400 having a movable element geometry orifice 435 in one position such that inner flow passage 152 is in free communication with the orifice 425 through the downstream passage 800.

FIG. 7S is a side view of the variable geometry nozzle 150 wherein the movable element 400 is in a different position described in FIG. 7T showing a restricted downstream passage.

FIG. 7T is a section view of the variable geometry nozzle 150 described in FIG. 7R wherein the movable element 400 is in different position when compared to the position described in FIG. 7R. In this figure the downstream passage 800 is having a shape of an opening having at least one straight side wherein the movable element 400 flow orifice 425 is in communication with the inner flow passage 152 on one side and to the orifice 425 on the other side.

Referring generally to FIGS. 8A-8L, FIGS. 8A-8L are detailed section views of an example of the variable geometry nozzle 150 wherein the movable element 400 has a curved surface and moves partially in rotation causing the change of downstream flow geometry 440.

Figure 8A:
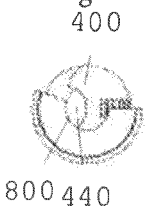
FIG. 8A is a detail view of a possible configuration of a variable geometry nozzle having one movable geometry element in different positions.

FIG. 8A is a front view of a partial cutaway example of the variable geometry nozzle 150 having one movable element 400 in one position such that the inner flow passage 152 is in communication with the orifice 425 through the downstream passage 800 wherein the downstream passage 800 geometry is of specific geometry generated by the movable element 400 interacting with the inner flow passage 152 when it is in this position.

Figure 8B:
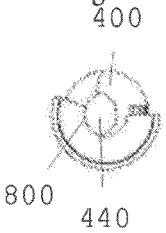
FIG. 8B is a detail view of a possible configuration of a variable geometry nozzle having one movable geometry element in different positions.

FIG. 8B is a partial section view of the variable geometry nozzle 150 described in FIG. 8A wherein the movable element 400 is not cut away in view.

Figure 8C:
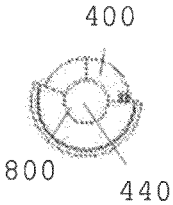
FIG. 8C is a detail view of a possible configuration of a variable geometry nozzle having one movable geometry element in different positions.

FIG. 8C is a partial section view from a tilted angle of the variable geometry nozzle 150 described in FIG. 8A wherein the movable element 400 is not cut away in view.

Figure 8D:
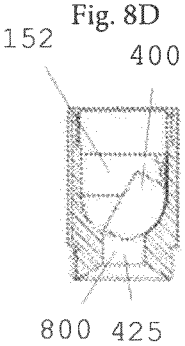
FIG. 8D is a detail view of a possible configuration of a variable geometry nozzle having one movable geometry element in different positions.

FIG. 8D is a section view of the variable geometry nozzle 150 described in FIG. 8A.

Figure 8E:
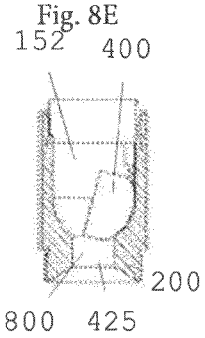
FIG. 8E is a detail view of a possible configuration of a variable geometry nozzle having one movable geometry element in different positions.

FIG. 8E is a front view of a partial cutaway example of the variable geometry nozzle 150 having one movable element 400 in a second position such that the inner flow passage 152 is in communication with the orifice 425 through the downstream passage 800 wherein the downstream passage 800 geometry is of specific geometry generated by the movable element 400 interacting with the inner flow passage 152 when it is in this position.

Figure 8F:
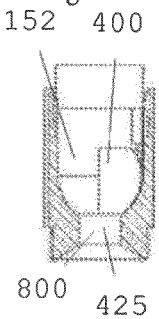
FIG. 8F is a detail view of a possible configuration of a variable geometry nozzle having one movable geometry element in different positions.

FIG. 8F is a partial section view of the variable geometry nozzle 150 described in FIG. 8E wherein the movable element 400 is not cut away in view.

Figure 8G:
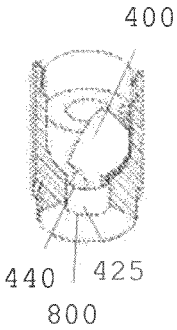
FIG. 8G is a detail view of a possible configuration of a variable geometry nozzle having one movable geometry element in different positions.

FIG. 8G is a partial section view from a tilted angle of the variable geometry nozzle 150 described in FIG. 8E wherein the movable element 400 is not cut away in view.

Figure 8H:
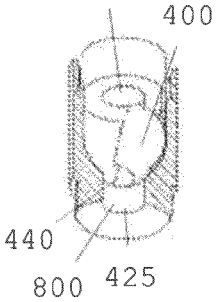
FIG. 8H is a detail view of a possible configuration of a variable geometry nozzle having one movable geometry element in different positions.

FIG. 8H is a section view of the variable geometry nozzle 150 described in FIG. 8E.

Figure 8I:
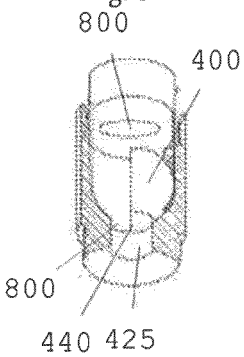
FIG. 8I is a detail view of a possible configuration of a variable geometry nozzle having one movable geometry element in different positions.

FIG. 8I is a front view of a partial cutaway example of the variable geometry nozzle 150 having one movable element 400 in a third position such that the inner flow passage 152 is in communication with the orifice 425 through the downstream passage 800 wherein the downstream passage 800 geometry is of specific geometry generated by the movable element 400 interacting with the inner flow passage 152 when it is in this position.

Figure 8J:
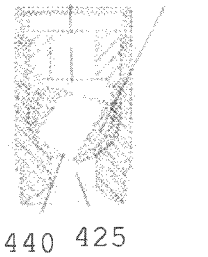
FIG. 8J is a detail view of a possible configuration of a variable geometry nozzle having one movable geometry element in different positions.

FIG. 8J is a partial section view of the variable geometry nozzle 150 described in FIG. 8I wherein the movable element 400 is not cut away in view.

Figure 8K:
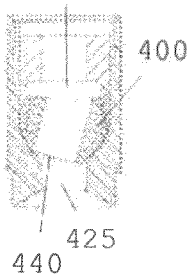
FIG. 8K is a detail view of a possible configuration of a variable geometry nozzle having one movable geometry element in different positions.

FIG. 8K is a partial section view from a tilted angle of the variable geometry nozzle 150 described in FIG. 8I wherein the movable element 400 is not cut away in view.

Figure 8L:
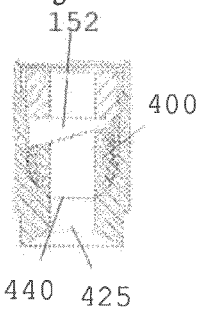
FIG. 8L is a detail view of a possible configuration of a variable geometry nozzle having one movable geometry element in different positions.

FIG. 8L is a section view of the variable geometry nozzle 150 described in FIG. 8I.

Referring generally to FIGS. 9A-9L, FIGS. 9A-9L are detailed section views of an example of the variable geometry nozzle 150 wherein two movable element 400 (*s*) are disposed within the body 200 and are having a curved surface and move partially in rotation causing the change of downstream flow geometry 440.

Figure 9A:
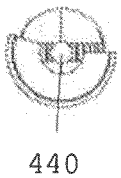
FIG. 9A is a detail view of a possible configuration of a variable geometry nozzle having two movable geometry elements in different positions.

FIG. 9A is a front view of a partial cutaway example of the variable geometry nozzle 150 having two movable element 400 (*s*) in one position such that the inner flow passage 152 is in communication with the orifice 425 through the downstream passage 800 wherein the downstream passage 800 geometry is of specific geometry generated by the movable element 400 (*s*) interacting with the inner flow passage 152 when it is in this position.

Figure 9B:
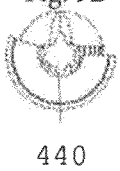
FIG. 9B is a detail view of a possible configuration of a variable geometry nozzle having two movable geometry elements in different positions.

FIG. 9B is a partial section view of the variable geometry nozzle 150 described in FIG. 9A wherein the movable element 400 (*s*) are not cut away in view.

Figure 9C:
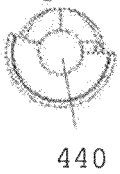
FIG. 9C is a detail view of a possible configuration of a variable geometry nozzle having two movable geometry elements in different positions.

FIG. 9C is a partial section view from a tilted angle of the variable geometry nozzle 150 described in FIG. 9A wherein the movable element 400 (*s*) are not cut away in view.

Figure 9D:
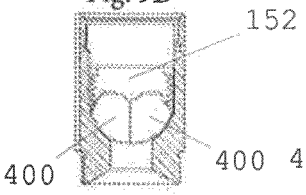
FIG. 9D is a detail view of a possible configuration of a variable geometry nozzle having two movable geometry elements in different positions.

FIG. 9D is a section view of the variable geometry nozzle 150 described in FIG. 9A.

Figure 9E:
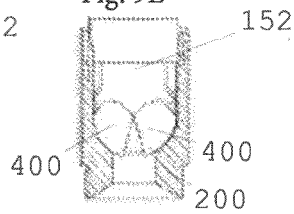
FIG. 9E is a detail view of a possible configuration of a variable geometry nozzle having two movable geometry elements in different positions.

FIG. 9E is a front view of a partial cutaway example of the variable geometry nozzle 150 having two movable element 400 (*s*) in a second position such that the inner flow passage 152 is in communication with the orifice 425 through the downstream passage 800 wherein the downstream passage 800 geometry is of specific geometry generated by the movable element 400 (*s*) interacting with the inner flow passage 152 when it is in this position.

Figure 9F:
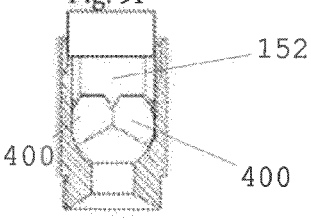
FIG. 9F is a detail view of a possible configuration of a variable geometry nozzle having two movable geometry elements in different positions.

FIG. 9F is a partial section view of the variable geometry nozzle 150 described in FIG. 9E wherein the movable element 400 (*s*) are not cut away in view.

Figure 9G:
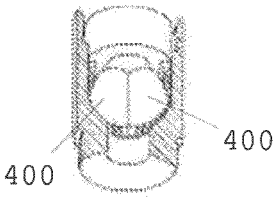
FIG. 9G is a detail view of a possible configuration of a variable geometry nozzle having two movable geometry elements in different positions.

FIG. 9G is a partial section view from a tilted angle of the variable geometry nozzle 150 described in FIG. 9E wherein the movable element 400 (*s*) are not cut away in view.

Figure 9H:
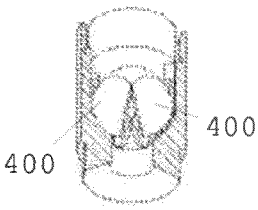
FIG. 9H is a detail view of a possible configuration of a variable geometry nozzle having two movable geometry elements in different positions.

FIG. 9H is a section view of the variable geometry nozzle 150 described in FIG. 9E.

Figure 9I:
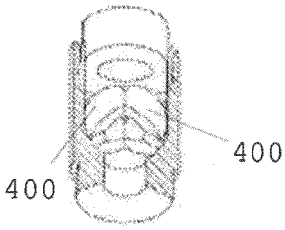
FIG. 9I is a detail view of a possible configuration of a variable geometry nozzle having two movable geometry elements in different positions.

FIG. 9I is a front view of a partial cutaway example of the variable geometry nozzle 150 having two movable element 400 (*s*) in a third position such that the inner flow passage 152 is in communication with the orifice 425 through the downstream passage 800 wherein the downstream passage 800 geometry is of specific geometry generated by the movable element 400 (*s*) interacting with the inner flow passage 152 when it is in this position.

Figure 9J:
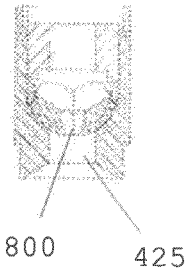
FIG. 9J is a detail view of a possible configuration of a variable geometry nozzle having two movable geometry elements in different positions.

FIG. 9J is a partial section view of the variable geometry nozzle 150 described in FIG. 9I wherein the movable element 400 (*s*) is not cut away in view.

Figure 9K:
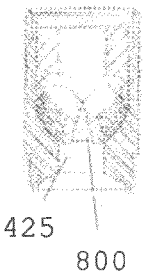
FIG. 9K is a detail view of a possible configuration of a variable geometry nozzle having two movable geometry elements in different positions.

FIG. 9K is a partial section view from a tilted angle of the variable geometry nozzle 150 described in FIG. 9I wherein the movable element 400 (*s*) are not cut away in view.

Figure 9L:
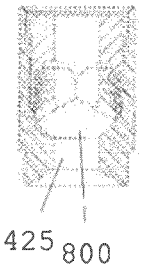
FIG. 9L is a detail view of a possible configuration of a variable geometry nozzle having two movable geometry elements in different positions.

FIG. 9L is a section view of the variable geometry nozzle 150 described in FIG. 9I.

Referring generally to FIGS. 10A-10L, FIGS. 10A-10L are detailed section views of an example of the variable geometry nozzle 150 wherein a plurality of movable element 400 (*s*) are disposed within the body 200 and have a curved surface and move partially in rotation causing the change of downstream flow geometry 440.

Figure 10A:
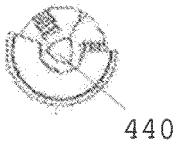
FIG. 10A is a detail view of a possible configuration of a variable geometry nozzle having three movable geometry elements in different positions.

FIG. 10A is a front view of a partial cutaway example of the variable geometry nozzle 150 having plurality movable element 400 (*s*) in one position such that the inner flow passage 152 is in communication with the orifice 425 through the downstream passage 800 wherein the downstream passage 800 geometry is of specific geometry generated by the movable element 400 (*s*) interacting with the inner flow passage 152 when it is in this position.

Figure 10B:
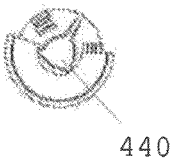
FIG. 10B is a detail view of a possible configuration of a variable geometry nozzle having three movable geometry elements in different positions.

FIG. 10B is a partial section view of the variable geometry nozzle 150 described in FIG. 10A wherein the movable element 400 (*s*) are not cut away in view.

Figure 10C:
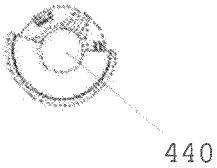
FIG. 10C is a detail view of a possible configuration of a variable geometry nozzle having three movable geometry elements in different positions.

FIG. 10C is a partial section view from a tilted angle of the variable geometry nozzle 150 described in FIG. 10A wherein the movable element 400 (*s*) are not cut away in view.

Figure 10D:
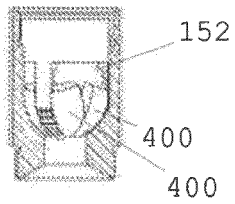
FIG. 10D is a detail view of a possible configuration of a variable geometry nozzle having three movable geometry elements in different positions.

FIG. 10D is a section view of the variable geometry nozzle 150 described in FIG. 10A.

Figure 10E:
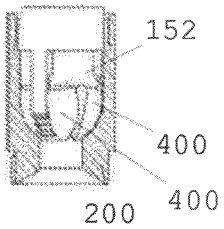
FIG. 10E is a detail view of a possible configuration of a variable geometry nozzle having three movable geometry elements in different positions.

FIG. 10E is a front view of a partial cutaway example of the variable geometry nozzle 150 having two movable element 400 (*s*) in a second position such that the inner flow passage 152 is in communication with the orifice 425 through the downstream passage 800 wherein the downstream passage 800 geometry is of specific geometry generated by the movable element 400 (*s*) interacting with the inner flow passage 152 when it is in this position.

Figure 10F:
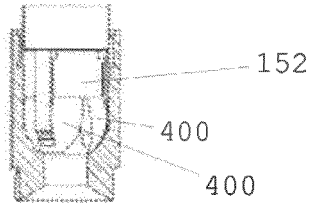
FIG. 10F is a detail view of a possible configuration of a variable geometry nozzle having three movable geometry elements in different positions.

FIG. 10F is a partial section view of the variable geometry nozzle 150 described in FIG. 10E wherein the movable element 400 (*s*) are not cut away in view.

Figure 10G:
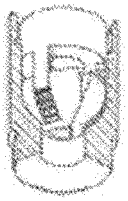
FIG. 10G is a detail view of a possible configuration of a variable geometry nozzle having three movable geometry elements in different positions.

FIG. 10G is a partial section view from a tilted angle of the variable geometry nozzle 150 described in FIG. 10-B-1 wherein the movable element 400 (*s*) are not cut away in view.

Figure 10H:
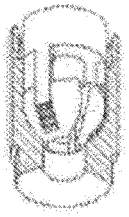
FIG. 10H is a detail view of a possible configuration of a variable geometry nozzle having three movable geometry elements in different positions.

FIG. 10H is a section view of the variable geometry nozzle 150 described in FIG. 10E.

Figure 10I:
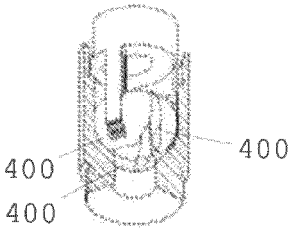
FIG. 10I is a detail view of a possible configuration of a variable geometry nozzle having three movable geometry elements in different positions.

FIG. 10I is a front view of a partial cutaway example of the variable geometry nozzle 150 having two movable element 400 (*s*) in a third position such that the inner flow passage 152 is in communication with the orifice 425 through the downstream passage 800 wherein the downstream passage 800 geometry is of specific geometry generated by the movable element 400 (*s*) interacting with the inner flow passage 152 when it is in this position.

Figure 10J:
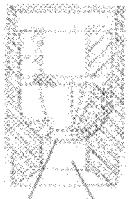
FIG. 10J is a detail view of a possible configuration of a variable geometry nozzle having three movable geometry elements in different positions.

FIG. 10J is a partial section view of the variable geometry nozzle 150 described in FIG. 10I wherein the movable element 400 (*s*) is not cut away in view.

Figure 10K:
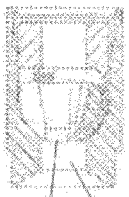
FIG. 10K is a detail view of a possible configuration of a variable geometry nozzle having three movable geometry elements in different positions.

FIG. 10K is a partial section view from a tilted angle of the variable geometry nozzle 150 described in FIG. 10I wherein the movable element 400 (*s*) are not cut away in view.

Figure 10L:
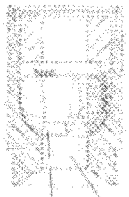
FIG. 10L is a detail view of a possible configuration of a variable geometry nozzle having three movable geometry elements in different positions.

FIG. 10L is a section view of the variable geometry nozzle 150 described in FIG. 10I.

Referring generally to FIGS. 11A-11D, FIGS. 11A-11D are detailed section views of an example of the variable geometry nozzle 150 where the movable element 400 is having at least one spherical surface and is biased by a resilient element 405 in connection between the movable element 400 and the body 200. The movable element 400 is placed such that it interact with the inner flow passage 152 when in different positions causing the downstream passage 800 to have different geometry.

Figure 11A:
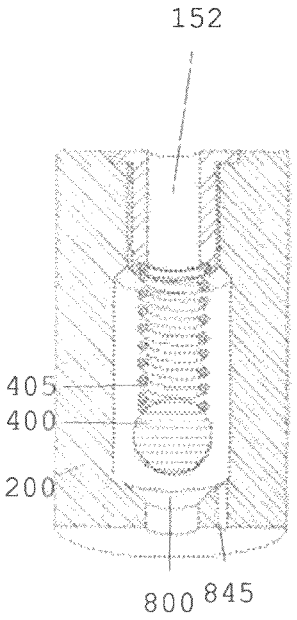
FIG. 11A is a detailed section view of one of an example set of possible configurations of a variable geometry nozzle showing a movable element in different positions.
Figure 11B:
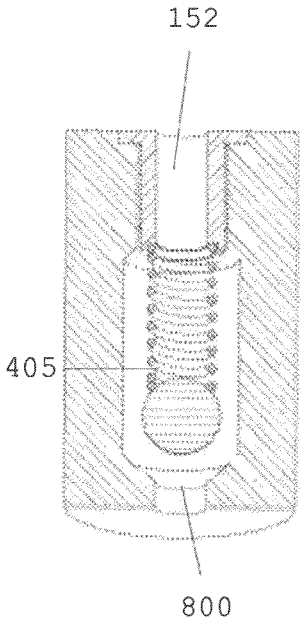
FIG. 11B is a detailed section view of one of an example set of possible configurations of a variable geometry nozzle showing a movable element in different positions.

FIG. 11A and FIG. 11B are showing the movable element 400 in two different positions with the downstream passage 800 in FIG. 11B is of more restricted geometry when compared to the downstream passage 800 of FIG. 11A.

Figure 11C:
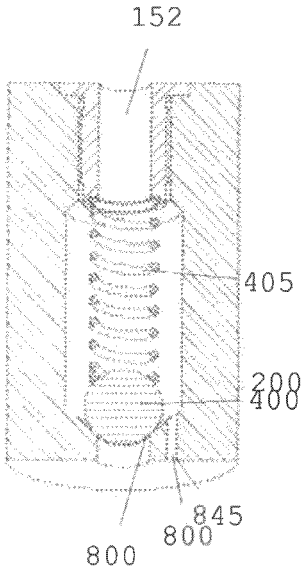
FIG. 11C is a detailed section view of one of an example set of possible configurations of a variable geometry nozzle showing a movable element in different positions.
Figure 11D:
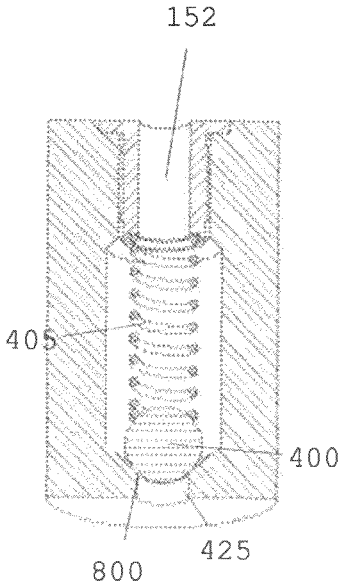
FIG. 11D is a detailed section view of one of an example set of possible configurations of a variable geometry nozzle showing a movable element in different positions.

FIG. 11C and FIG. 11D are similar to FIG. 11A and FIG. 11B except that the downstream passage 800 of FIGS. 11C and 11D are of larger area caused by the placement of flow enlargement conduit 845 permanently in communication between the inner flow passage 152 and the orifice 425.

Figure 12A:
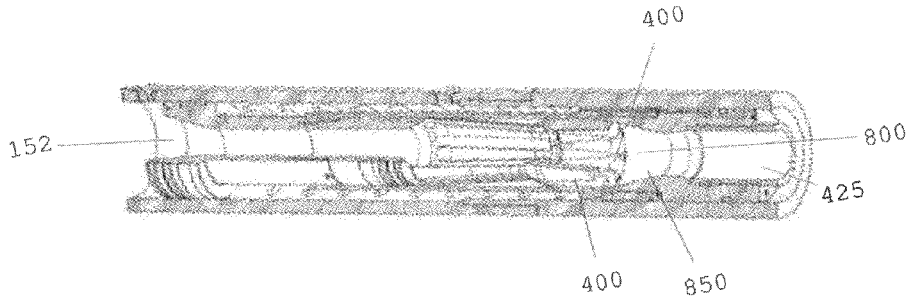
FIG. 12A is a partial cut out view of one of an example set of possible configurations of variable geometry nozzles showing a movable element in different positions.
Figure 12B:
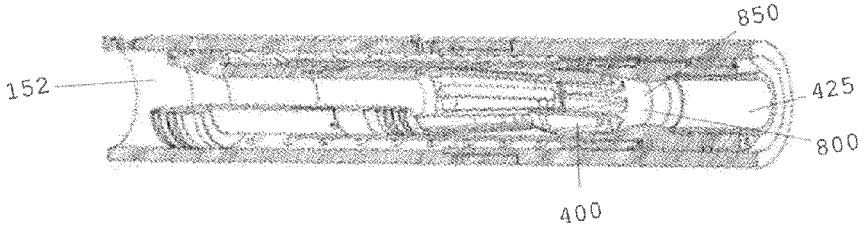
FIG. 12B is a partial cut out view of one of an example set of possible configurations of variable geometry nozzles showing a movable element in different positions.
Figure 12C:
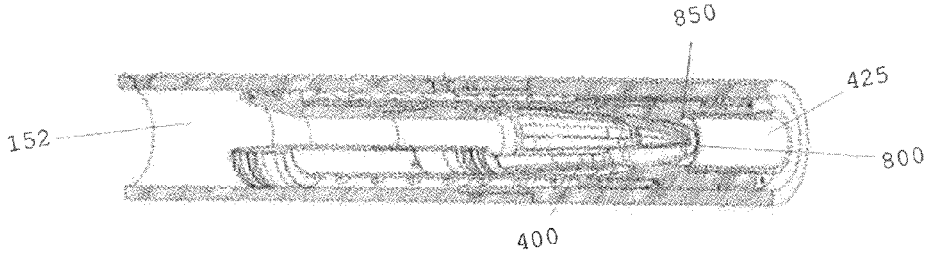
FIG. 12C is a partial cut out view of one of an example set of possible configurations of variable geometry nozzles showing a movable element in different positions.

Referring generally to FIGS. 12A-12C, FIGS. 12A-12C are detailed section views of an example of the variable geometry nozzle 150 wherein a plurality of movable element 400 (*s*) are disposed within the body 200 and move partially axially guided by a guide surface 850 disposed within the body 200 and while in contact with at least one of the movable element 400 (*s*) at least one time when the movable element 400 is traversing its travel pass. The guided movement causes the change of downstream flow geometry 440.

FIG. 12A is a partial cut away view of an example of the variable geometry nozzle 150 having plurality movable element 400 (*s*) in one position such that the inner flow passage 152 is in communication with the orifice 425 through the downstream passage 800 wherein the downstream passage 800 geometry is of specific geometry generated by the movable element 400 (*s*) interacting with the inner flow passage 152 when it is in this position and guided by the guide surface 850.

FIG. 12B is a partial cut away view of an example of the variable geometry nozzle 150 having plurality movable element 400 (*s*) in a second position such that the inner flow passage 152 is in communication with the orifice 425 through the downstream passage 800 wherein the downstream passage 800 geometry is of specific geometry generated by the movable element 400 (*s*) interacting with the inner flow passage 152 when it is in this position and guided by the guide surface 850. The downstream passage 800 is having a less flow area in this position when compared to the flow area of the downstream passage 800 of FIG. 12A.

FIG. 12C is a partial cut away view of an example of the variable geometry nozzle 150 having plurality movable element 400 (*s*) in a second position such that the inner flow passage 152 is in communication with the orifice 425 through the downstream passage 800 wherein the downstream passage 800 geometry is of specific geometry generated by the movable element 400 (*s*) interacting with the inner flow passage 152 when it is in this position and guided by the guide surface 850. The downstream passage 800 is having a less flow area In this position when compared to the flow area of the downstream passage 800 of FIG. 12B.

Figure 13A:
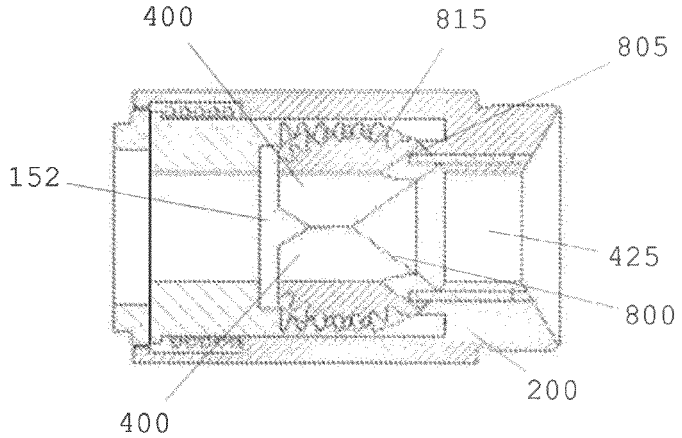
FIG. 13A is a detailed section view of an example of a possible configuration of a variable geometry nozzle showing movable elements in different positions and a restrictive element disposed within the nozzle body.
Figure 13B:
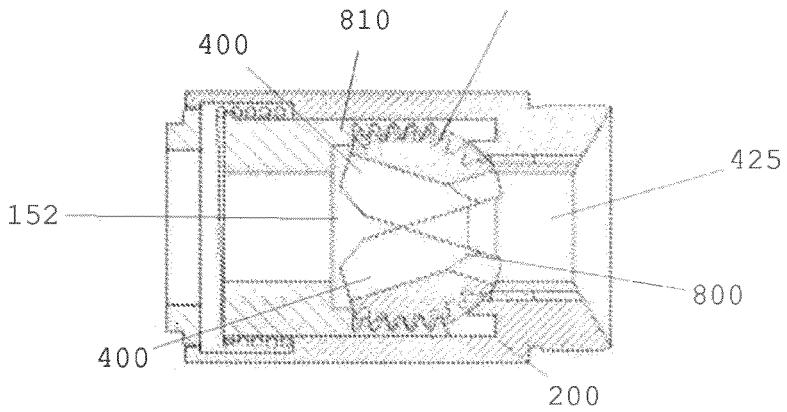
FIG. 13B is a detailed section view of an example of a possible configuration of a variable geometry nozzle showing movable elements in different positions and a restrictive element disposed within the nozzle body.
Figure 13C:
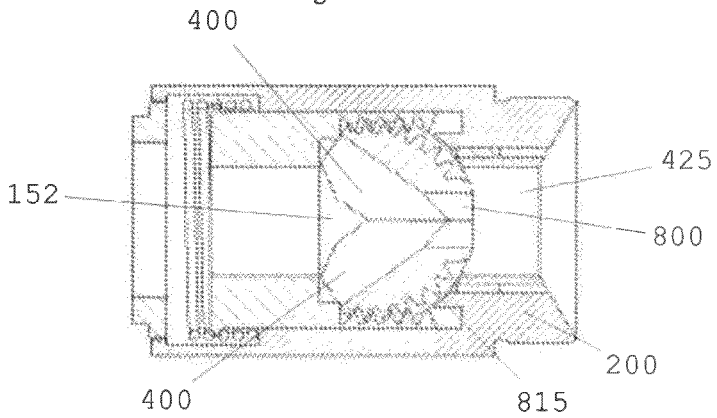
FIG. 13C is a detailed section view of an example of a possible configuration of a variable geometry nozzle showing movable elements in different positions and a restrictive element disposed within the nozzle body.

Referring generally to FIGS. 13A-13C, FIGS. 13A-13C are detailed section views of an example of the variable geometry nozzle 150 explained in FIGS. 8, 9 and 10 having a restricting pin to prevent undesired movement of the movable element 400. Enough force has to be exerted on the pin by the movable element 400 caused by a driving member to break the pin and allow for the movable element 400 to change position.

FIG. 13A is a section view of one example of the variable geometry nozzle 150 having a driving member in a form of a threaded rack 810 engaged with a matching threaded groves on the movable element 400 surface such that when the rack 810 moves in certain direction it exerts a force on the pinion 815 in connection with the movable element 400. When this force exceed a value set to break the restriction pin 805, then the pin will break and the movable element 400 will move in partial rotation in response to the movement of the rack 810.

FIG. 13B is a section view of one example of the variable geometry nozzle 150 described in FIG. 13A wherein the movable element 400 (*s*) are in different position when compared to the position in FIG. 13A and the downstream geometry is accordingly different from the downstream geometry generated by the movable element 400 in FIG. 13A.

FIG. 13C is a section view of one example of the variable geometry nozzle 150 described in FIG. 13B wherein the movable element 400 (*s*) are in different position when compared to the position in FIG. 13B and the downstream geometry is accordingly different from the downstream geometry generated by the movable element 400 in FIG. 13B.

Referring generally to FIGS. 14A-14D, FIGS. 14A-14D are detailed section views of an example of the variable geometry nozzle 150 described in FIGS. 5A-5H wherein the movable element movement direction 825 is controlled by the circulation pattern under the effect of the fluid flow direction 820.

Figure 14A:
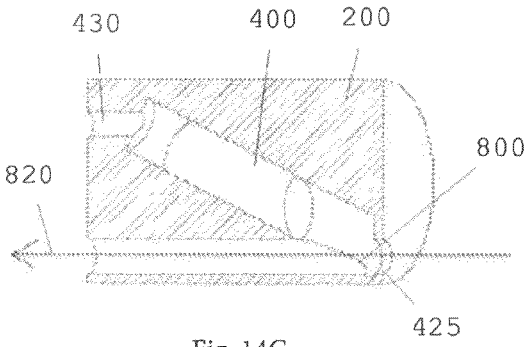
FIG. 14A is a section view of an example of a variable geometry nozzle showing a movable element in different positions under the effect of a change of fluid flow direction.

FIG. 14A showing the effect of fluid flow from the orifice 425 towards the inner flow passage 152 in what is known in the industry as reverse circulation. This flow direction 820 forces the movable element 400 away from the inner flow passage 152 and resulting in a downstream passage 800 of specific geometry.

Figure 14B:
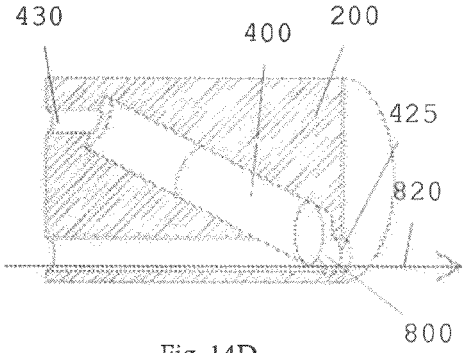
FIG. 14B is a section view of an example of a variable geometry nozzle showing a movable element in different positions under the effect of a change of fluid flow direction.

FIG. 14B is a section view of an example of the variable geometry nozzle 150 described in FIG. 14A wherein the fluid flossing from the inner flow passage 152 in the direction of the orifice 425 in what is known in the art as normal circulation. Fluid force the movable element 400 to engage with the inner flow passage 152 and result in a downstream passage 800 geometry of different geometry when compared to the downstream geometry generated by the movement in FIG. 14A. It is worth to note that the movable element 400 can be arranged such that that the downstream passage 800 geometry in FIG. 14A is larger or smaller than the downstream passage 800 geometry of FIG. 14B.

Figure 14C:
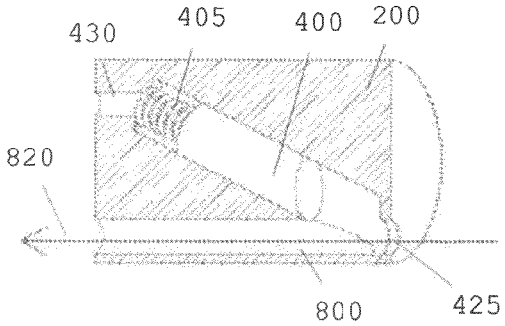
FIG. 14C is a section view of an example of a variable geometry nozzle showing a movable element in different positions under the effect of a change of fluid flow direction.

FIG. 14C is a section view of an example of the variable geometry nozzle 150 described in FIG. 14A under the effect of reverse circulation wherein a resilient element 405 as described in FIG. 5C insure that the movable element 400 is biased in certain direction such that its movement by effect of fluid flow starts when the force exerted by the fluid flowing through the variable geometry nozzle 150 exceed the force imposed by the resilient element 405.

Figure 14D:
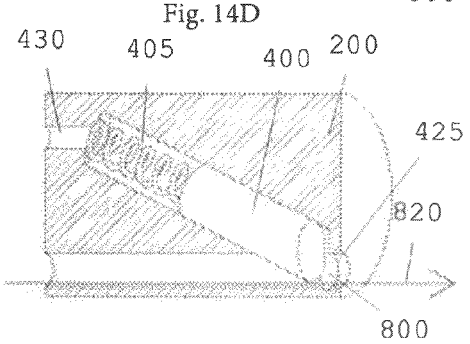
FIG. 14D is a section view of an example of a variable geometry nozzle showing a movable element in different positions under the effect of a change of fluid flow direction.

FIG. 14D is a section view of an example of the variable geometry nozzle 150 described in FIG. 14C wherein the movable element 400 is in a different position under the effect of normal circulation when compared to FIG. 14C and resulting in a downstream passage 800 of different geometry.

FIGS. 15A-15D depict examples of the variable geometry nozzle 150 described in FIGS. 5E and 5F wherein the movable element movement direction 825 is controlled by the circulation pattern.

Figure 15A:
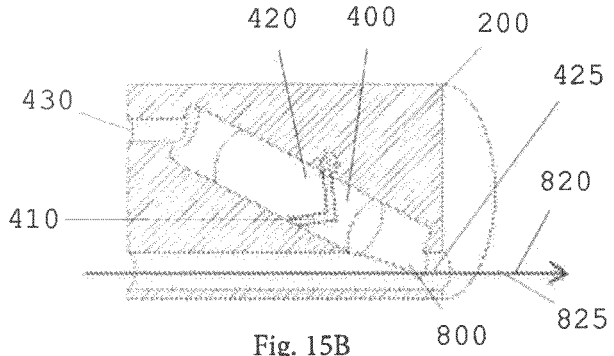
FIG. 15A is a section view of an example of a variable geometry nozzle using a cam to change passage geometry through a cycling movement.
Figure 15B:
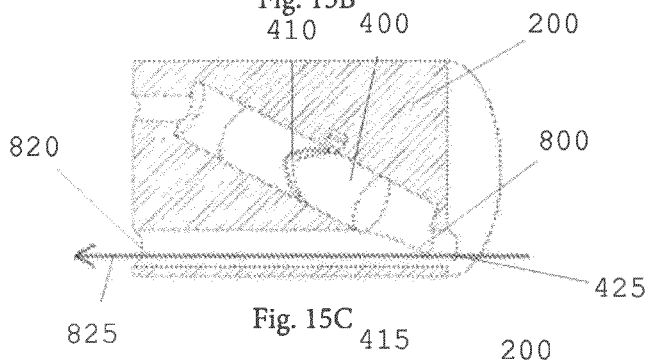
FIG. 15B is a section view of an example of a variable geometry nozzle using a cam to change passage geometry through a cycling movement.
Figure 15C:
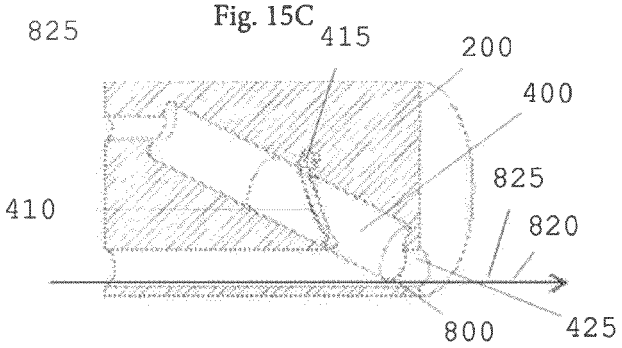
FIG. 15C is a section view of an example of a variable geometry nozzle using a cam to change passage geometry through a cycling movement.
Figure 15D:
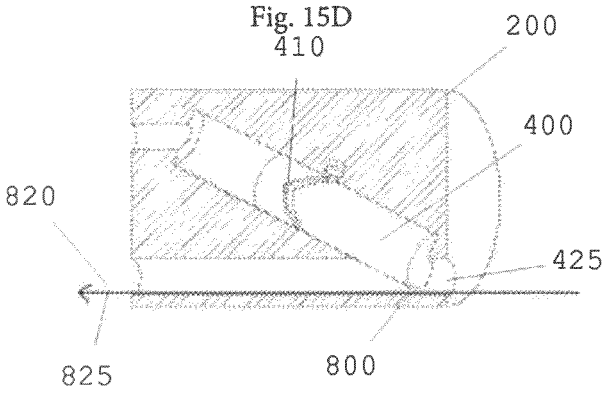
FIG. 15D is a section view of an example of a variable geometry nozzle using a cam to change passage geometry through a cycling movement.

FIG. 15A is an example of the variable geometry nozzle 150 described in FIG. 5E wherein the normal circulation from inner flow passage 152 to the orifice 425 cause the movable element 400 to change position guided by the cam follower 415 traversing the cam track 410 in a determined spacing and direction. When fluid flow direction 820 is reversed in what is known reverse circulation or when it is moving from the orifice 425 direction towards inner flow passage 152, then it will force the movable element 400 to change position to another direction guided by the cam 420 flower traversing the cam track 410 and resulting in the movable element 400 interacting with the inner flow passage 152 and causing the downstream passage 800 to have certain geometry as seen in FIG. 15B. The cyclic movement of fluid flowing in normal flow direction 820 or reverse flow direction 820 will cause the movable element 400 to move within the variable geometry nozzle 150 body 200 as guided by the cam 420 and as a result the movable element 400 will engage with the inner flow passage 152 at different predetermined positions and stays in the same position until the fluid is reversed in circulation.

This is the main principle of the method disclosed in here to control the geometry of the variable geometry nozzle 150 apparatus and keep it at a certain position during the desired operation.

FIGS. 16A-16D are examples of possible placements of preferred examples of the variable geometry nozzle 150 apparatus within the tubular string 110.

Figure 16B:
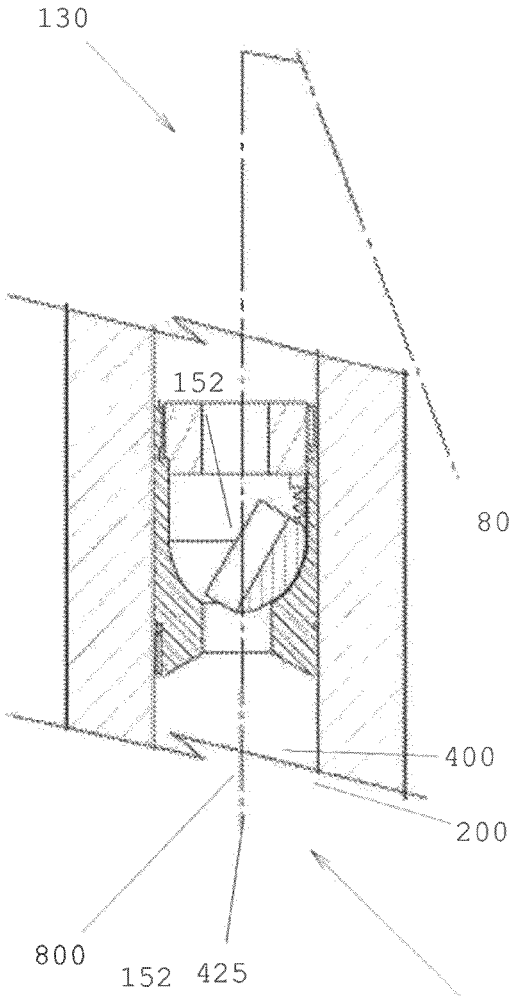
FIG. 16B is a detail view of a possible disposition of a variable geometry nozzle in a drilling bit or drilling tubular conduit.
Figure 16D:
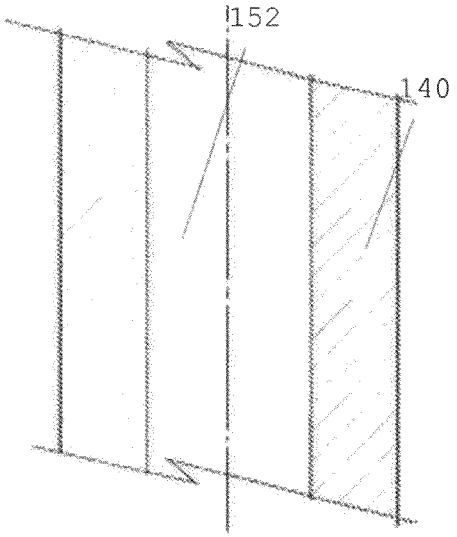
FIG. 16D is a detail view of a possible disposition of a variable geometry nozzle in a drilling bit or drilling tubular conduit.
Figure 16C:
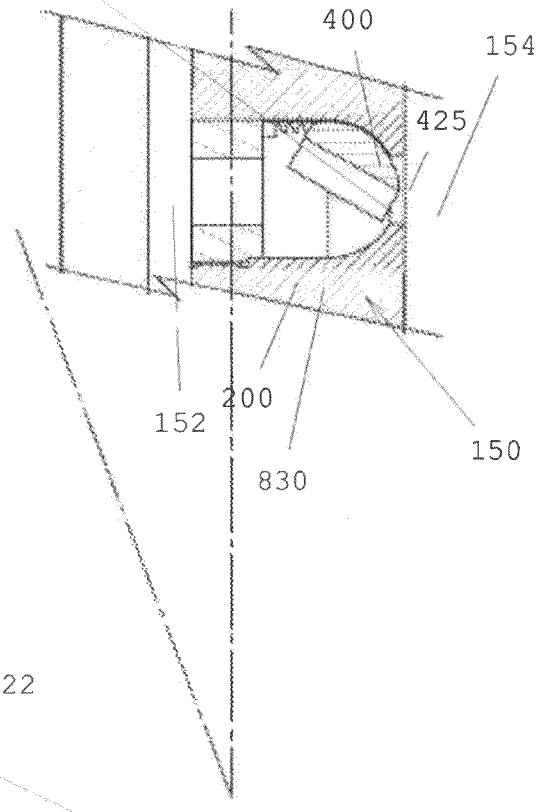
FIG. 16C is a detail view of a possible disposition of a variable geometry nozzle in a drilling bit or drilling tubular conduit.
Figure 16A:
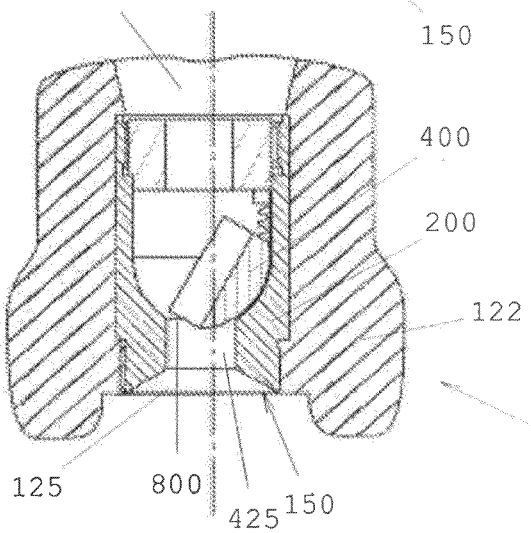
FIG. 16A is a detail view of a possible disposition of a variable geometry nozzle in a drilling bit or drilling tubular conduit.

FIG. 16A is a section view of an example wherein the variable geometry nozzle 150 is placed in bit perforation 125 and the result is a bit having a remotely operated variable geometry nozzle 150. FIG. 16B is a section view of an example of the variable geometry nozzle 150 disposed within a tubular string 110 having a downstream passage 800 of variable geometry affecting the fluid flow profile flowing between the inner flow passage 152 and the orifice 425. FIG. 16C is a section view of an example of the variable geometry nozzle 150 disposed between the inner flow passage 152 and the annular flow passage 154 controlling the flow profile and flow pattern between the inner flow passage 152 and the annular flow passage 154 according to the downstream passage 800 geometry. This figure is showing a possible example of the variable geometry nozzle 150 wherein the variable geometry nozzle 150 body 200 is an integrated body 830 element within the bottom hole assembly 130.

FIG. 16D is an example of a portion of a tubular string 110 member such as a drill pipe 140.

Figure 17:
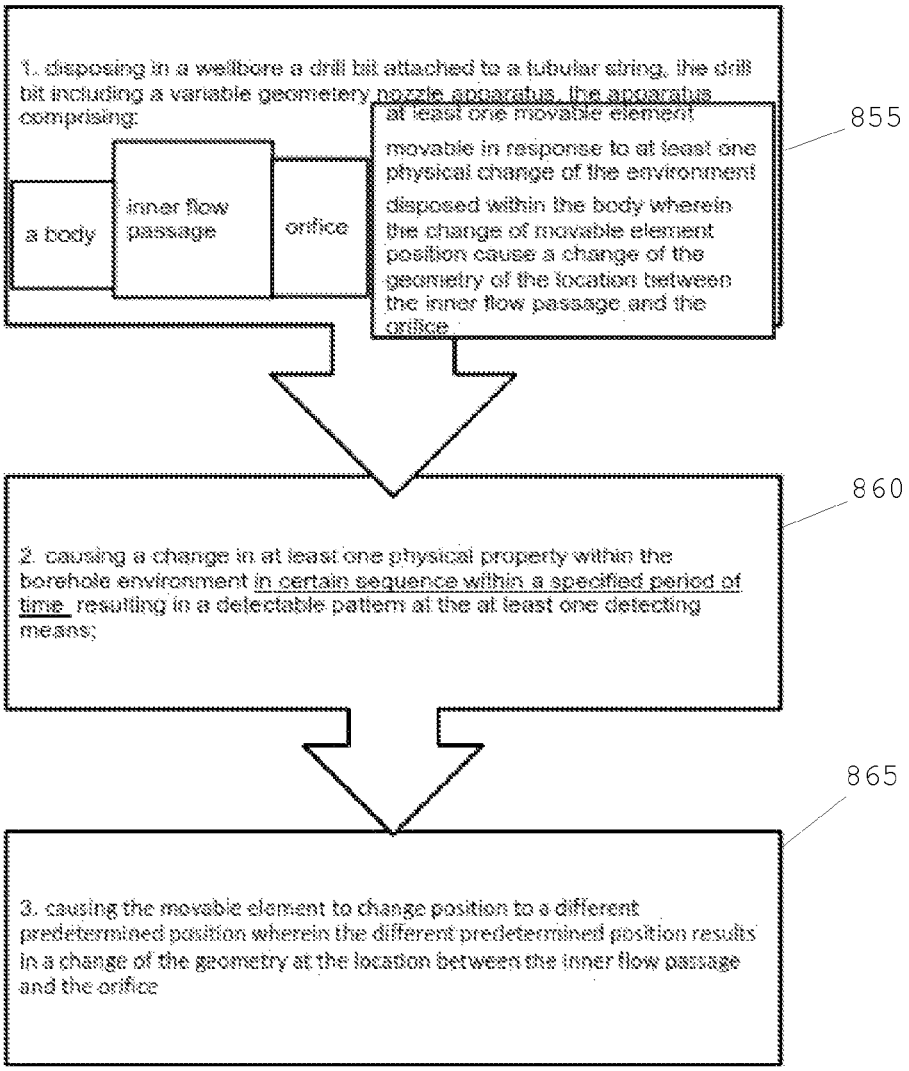
FIG. 17 is a diagram depicting steps used for the method of remotely controlling the variable geometry nozzle.

FIG. 17 is a flowchart diagram describing the method disclosed for remotely controlling the variable geometry nozzle 150. Step 1 855 is to dispose in a well bore the variable geometry nozzle 150. Step 2 860 is to cause at least one physical change of the environment. Step 3 865 causing the movable element 400 to change position to a different predetermined position wherein the different predetermined position results in a change of the geometry at the location between the inner flow passage 152 and the orifice 425.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

We claim:

1. An apparatus for remotely changing the flow profile in a conduit and rotary drill bit based on changing the environment in the borehole, the apparatus comprising:

a nozzle adapted for use in a rotary drill bit for drilling an earth borehole, the nozzle comprising:

a body configured to be secured within the rotary drill bit, at least one fluid passage of variable geometry through the body for connecting a fluid through the body, an orifice disposed within the body, in fluid communication with the at least one fluid passage and the borehole, and a means for changing the geometry of the at least one fluid passage having at least one movable element, in fluid communication with the fluid passage and the orifice, wherein the at least one movable element is movable from an initial position to at least one other predetermined position in response to intended changes in the borehole environment;

the apparatus further comprising at least one means for detecting a plurality of intended changes in at least one physical property of the borehole environment, said plurality of intended changes functioning as a detectable signal, the means for detecting the plurality of intended changes in at least one physical property of the borehole environment further being configured to interpret the signal;

a means for actuating the means for changing the geometry of the at least one fluid passage, wherein the means for actuating the means for changing the geometry of the at least one fluid passage is operationally linked to the means for detecting the plurality of intended changes in at least one physical property of the borehole environment; and a means for powering the means for actuating the at least one movable element.

2. The nozzle of claim 1, wherein the at least one moveable element is movable from an initial position to another predetermined position under normal fluid circulation, wherein said normal fluid circulation comprises fluid circulation from the drill bit to the borehole, and wherein the at least one moveable element is movable from an initial position to a different predetermined position under reverse fluid circulation, wherein said reverse fluid circulation comprises fluid circulation from the borehole to the drill bit.

3. The apparatus of claim 1 wherein the at least one detecting means comprises a sensor.

4. The apparatus of claim 1 wherein the actuating means comprises an electric motor.

5. The apparatus of claim 1, wherein the actuating means comprises a movable rack, and wherein the rack is mechanically engaged with the at least one movable element.

6. The apparatus of claim 1 wherein the powering means comprises an energy harvester.

7. The apparatus of claim 6 wherein the apparatus further comprises a tubular string in fluid communication with the apparatus, and wherein the energy harvester is set to receive hydraulic energy from fluid flow in the tubular string and is configured to provide electrical energy to the means for actuating.

8. The apparatus of claim 6 wherein:

fluid is transferred from the at least one fluid passage to the orifice disposed within the body in fluid communication with the at least one fluid passage, and from the orifice disposed within the body to the borehole in fluid communication with the orifice disposed within the body, and wherein the fluid transferred from the orifice to the borehole is designated as wellbore fluid; and wherein the energy harvester is set to receive hydraulic energy from a fluid pressure difference between the inner fluid passage and the wellbore fluid.

9. The apparatus of claim 6 wherein the energy harvester is set to receive thermal energy from a temperature difference between two points within the drill bit and is configured to provide electrical energy to the means for actuating.

10. The apparatus of claim 1 wherein the powering means comprises an energized resilient element.

11. The apparatus of claim 1 wherein the powering means comprises a battery.

12. A method for drilling an earth borehole based on changing the environment in the borehole, the method including:

disposing in a wellbore a drill bit attached to a tubular string, the drill bit including an apparatus, the apparatus comprising:

a nozzle adapted for use in a rotary drill bit for drilling Earth borehole, the nozzle comprising:

a body configured to be secured within the rotary drill bit, at least one fluid passage of variable geometry through the body for connecting a fluid through the body, an orifice disposed within the body, in fluid communication with the at least one fluid passage and the borehole, and a means for changing the geometry of the at least one fluid passage having at least one movable element, in fluid communication with the fluid passage and the orifice, wherein the at least one movable element is movable from an initial position to at least one other predetermined position in response to intended changes in the borehole environment;

the apparatus further comprising at least one means for detecting a plurality of intended changes in at least one physical property of the borehole environment, said plurality of intended changes functioning as a detectable signal, the means for detecting the plurality of intended changes in at least one physical property of the borehole environment further being configured to interpret the signal;

a means for actuating the means for changing the geometry of the at least one fluid passage, wherein the means for actuating the means for changing the geometry of the at least one fluid passage is operationally linked to the means for detecting the plurality of intended changes in at least one physical property of the borehole environment; and a means for powering the means for actuating the at least one movable element;

the method further comprising causing a change in at least one physical property within the borehole environment in certain sequence within a specified period of time resulting in a detectable pattern at the at least one detecting means; and causing the actuating means to use the energy provided by the powering means to change the geometry of the at least one fluid passage within the nozzle.

13. The method of claim 12 wherein the change in a physical property of the environment is a mechanical movement of the apparatus by means of moving the tubular string, causing the apparatus to move within the wellbore in at least one direction detectable by the detecting means.

14. The method of claim 12 wherein the change of physical property includes a change in one or more of the following fluid properties: pressure, temperature, flow rate, density, viscosity, color, and composition, detectable by the detecting means.

15. The method of claim 12 wherein the change in a physical property includes a change in one or more of the following physical properties: electromagnetic, electrostatic, and seismic, detectable by the said detecting means.

16. The method of claim 12, wherein changing the geometry of the at least one fluid passage includes reducing the area of the nozzle orifice to increase the velocity of the nozzle jet.

17. The method of claim 12, wherein changing the geometry of the at least one fluid passage includes increasing the area of the nozzle orifice to decrease the velocity of the nozzle jet.

18. The method of claim 12 wherein the change of physical property includes a change in the direction of flow circulation.

19. The method of claim 18, wherein changing the geometry of the at least one fluid passage includes moving the at least one movable element from a first position to a second position when the flow is circulated in one direction and moving the at least one movable element from the second position to the first position when the flow is circulated in the opposite direction.

20. The method of claim 19, wherein the apparatus further includes a cam and a latch to hold the at least one movable element in a position resulting in the desired change of the geometry of the at least one fluid passage and allowing the flow circulation to be changed.

21. The method of claim 12, wherein the actuating means includes an actuator selected from at least one of a rack-type actuator, an electric motor, a solenoid, and a cam-type actuator.

22. The method of claim 21, wherein the rack-type actuator includes at least one rack, and actuating the means for changing the geometry of the at least one fluid passage includes moving the rack between a first position and a second position.

23. The method of claim 12, wherein the powering means includes a power source selected from at least one of a hydraulic power, an energized resilient element, a battery, a super capacitor, and an energy harvester.

24. The method of claim 23, wherein the energy harvester is selected from at least one of an electromagnetic induction harvester, a piezoelectric harvester, and a thermoelectric harvester.

25. The method of claim 23, wherein the hydraulic power includes creating a net pressure force on the surfaces of the movable element exposed to the fluid passing through the nozzle.

* * * * *